US010111284B2

(12) United States Patent
Zhang et al.

(10) Patent No.: US 10,111,284 B2
(45) Date of Patent: Oct. 23, 2018

(54) LIGHT DRIVING CIRCUIT

(71) Applicant: Delta Electronics (Shanghai) Co., Ltd., Shanghai (CN)

(72) Inventors: Wei-Qiang Zhang, Shanghai (CN); Li-Zhi Xu, Shanghai (CN); Zhi-Hui Ding, Shanghai (CN)

(73) Assignee: DELTA ELECTRONICS (SHANGHAI) CO., LTD., Shanghai (CN)

( * ) Notice: Subject to any disclaimer, the term of this patent is extended or adjusted under 35 U.S.C. 154(b) by 756 days.

(21) Appl. No.: 14/476,695

(22) Filed: Sep. 3, 2014

(65) Prior Publication Data

US 2015/0173143 A1 Jun. 18, 2015

(30) Foreign Application Priority Data

Dec. 13, 2013 (CN) ..... 2013 1 0685071

(51) Int. Cl.
*H05B 33/08* (2006.01)

(52) U.S. Cl.
CPC ..... *H05B 33/0815* (2013.01); *H05B 33/0827* (2013.01)

(58) Field of Classification Search
CPC ..... H05B 33/0815; H05B 33/0827; H05B 33/0818; H05B 33/0809; H05B 33/0848; H05B 33/0824; H05B 33/0887; H05B 37/0209; H05B 39/045; H05B 41/2825; H05B 41/2856
USPC ..... 315/291–294, 219, 307, 30
See application file for complete search history.

(56) References Cited

U.S. PATENT DOCUMENTS

2010/0109537 A1* 5/2010 Nishino ..... H05B 33/0827 315/185 R
2010/0164393 A1* 7/2010 Chang ..... H05B 33/0818 315/279
2011/0037399 A1* 2/2011 Hung ..... H05B 33/0815 315/219
2011/0096055 A1* 4/2011 Lin ..... H05B 33/0818 345/211

(Continued)

FOREIGN PATENT DOCUMENTS

CN 101355304 A 1/2009
CN 102098833 A 6/2011

(Continued)

*Primary Examiner* — Douglas W Owens
*Assistant Examiner* — Amy Yang
(74) *Attorney, Agent, or Firm* — CKC & Partners Co., Ltd.

(57) ABSTRACT

A light driving circuit includes a first and second illuminant unit, a power conversion unit, a first and second switching unit, and a first control unit. The power conversion unit receives an input voltage and converts the input voltage into an output voltage. The first switching unit is coupled to the first illuminant unit. When the first switching unit is turned on, the first illuminant unit is driven by the output voltage to emit light and generate a first output current. The second switching unit is coupled to the second illuminant unit. When the second switching unit is turned on, the second illuminant unit is driven by the output voltage to emit light and generate a second output current. The first control unit controls the first switching unit and the second switching unit to be turned on/off according to the first output current and the second current, respectively.

9 Claims, 17 Drawing Sheets

(56) References Cited

U.S. PATENT DOCUMENTS

| | | | | |
|---|---|---|---|---|
| 2012/0075544 | A1* | 3/2012 | Sasaki | G02F 1/133603 349/42 |
| 2013/0241438 | A1* | 9/2013 | Suzuki | H02J 1/00 315/295 |

FOREIGN PATENT DOCUMENTS

| | | | |
|---|---|---|---|
| CN | 102624235 | A | 8/2012 |
| CN | 202949364 | U | 5/2013 |
| TW | 201106800 | A | 2/2011 |
| TW | 201115873 | A | 5/2011 |
| TW | I397348 | B | 5/2013 |

* cited by examiner

LIGHT DRIVING CIRCUIT

RELATED APPLICATIONS

This application claims priority to China Application Serial Number 201310685071.5, filed Dec. 13, 2013, which is herein incorporated by reference.

BACKGROUND

Field of Invention

The present disclosure relates to a light driving circuit. More particularly, the present disclosure relates to a light driving circuit for driving a plurality of light emitting diode strings.

Description of Related Art

Light emitting diodes (LEDs), having the advantages of high durability, long life, low power consumption together with not containing harmful substances such as mercury, have gradually replaced the traditional bulbs or halogen lamps in lighting market today. When a light emitting diode serves as a light source, a plurality of light emitting diode strings are usually utilized. In addition to that, a driving circuit independently controlling the light emitting diode strings is added to achieve uniform light source or light color regulation.

Traditionally, a light driving circuit for driving a plurality of light emitting diode strings comprises a plurality of buck converters operating independently to respectively drive the light emitting diode strings. FIG. 1 depicts a schematic diagram of a light driving circuit 100 according to the prior art. As shown in FIG. 1, a light driving circuit 100 comprises a power conversion unit 10, a first illuminant unit 11, a second illuminant unit 12, a first buck conversion unit 13, and a second buck conversion unit 14. The first illuminant unit 11 comprises a first light emitting diode string 111 and a first capacitor C. The first capacitor C is connected in parallel with the first light emitting diode string 111. The second illuminant unit 12 comprises a second light emitting diode string 121 and a second capacitor C. The second capacitor C is connected in parallel with the second light emitting diode string 121. The first buck conversion unit 13 comprises a first controller 131. The second buck conversion unit 14 comprises a second controller 141. The first buck conversion unit 13 and the second buck conversion unit 14 are respectively connected to the first illuminant unit 11 and the second illuminant unit 12. In addition, the first buck conversion unit 13 and the second buck conversion unit 14 control currents for driving the first illuminant unit 11 and the second illuminant unit 12 through the first controller 131 and the second controller 141, respectively.

Take the first illuminant unit 11 for example, the power conversion unit 10 is configured for receiving an input voltage Vin and converting the input voltage Vin into an output voltage Vout that is configured for driving the first illuminant unit 11 and the second illuminant unit 12. When a switch S is turned on, a diode D is reverse biased. At this time, the first illuminant unit 11 is driven by the output voltage Vout to generate a current flowing through an inductor L, the switch S, and a resistor R and energy is stored in the inductor L. When the switch S is turned off, the current flows through the diode D and the first illuminant unit 11 because the current in the inductor L cannot change suddenly so that freewheeling is achieved.

In order to drive each of the illuminant units, a buck converter and a control circuit need to be disposed correspondingly in the prior art light driving circuit (for example: when the driving circuit needs to drive three illuminant units, three independent buck converters and three independent control circuits are required to allow each of the illuminant units to be driven). As a result, when the number of the illuminant units is increased, the structure of the light driving circuit becomes more complex, which in turn increases the manufacturing cost of the light driving circuit.

For the forgoing reason, there is a need for solving the above-mentioned problem by providing a light driving circuit.

SUMMARY

The present disclosure relates to a light driving circuit that utilizes one control unit to control and drive each of the illuminant units without disposing the buck converters. That is, only one control unit is required to control and drive a plurality of illuminant units, and no buck converter is necessary to be disposed in each of the illuminant units.

One aspect of the present disclosure is to provide a light driving circuit. The light driving circuit comprises a first illuminant unit, a second illuminant unit, a power conversion unit, a first switching unit, a second switching unit, and a first control unit. The power conversion unit is configured for generating an output voltage. The first switching unit is coupled to the first illuminant unit. The first illuminant unit is driven by the output voltage to emit light and generate a first output current when the first switching unit is turned on. The second switching unit is coupled to the second illuminant unit. The second illuminant unit is driven by the output voltage to emit light and generate a second output current when the second switching unit is turned on. The first control unit is configured for controlling the first switching unit and the second switching unit to be turned on and turned off according to the first output current and the second output current, respectively.

In an embodiment, the first control unit turns on the first switching unit at a first time. The first control unit turns off the first switching unit and turns on the second switching unit when the first output current reaches a rated current value.

In an embodiment, the first control unit turns on the first switching unit and the second switching unit at a first time. The first control unit turns off the second switching unit when the second output current reaches a rated current value.

In an embodiment, the first control unit generates a first control signal according to the first output current which is configured for controlling a duration of an on time of the first switching unit, and generates a second control signal according to the second output current which is configured for controlling a duration of an on time of the second switching unit.

In an embodiment, the power conversion unit comprises a third switching unit and a second control unit. The second control unit is coupled to the third switching unit configured for generating a third control signal according to a feedback signal. The third control signal is configured for controlling a duration of an on time of the third switching unit. The power conversion unit generates the output voltage when the second control unit turns off the third switching unit.

In an embodiment, the first control unit generates the feedback signal according to the first output current and/or the second output current.

In an embodiment, the first control unit turns on the first switching unit when the second control unit turns off the third switching unit. The first control unit turns off the first switching unit and turns on the second switching unit when the first output current reaches a rated current value. The first control unit turns off the second switching unit and the second control unit turns on the third switching unit when the second output current is zero.

In an embodiment, the first control unit turns on the first switching unit and the second switching unit when the second control unit turns off the third switching unit. The first control unit turns off the second switching unit when the second output current reaches a rated current value. The first control unit turns off the first switching unit and the second control unit turns on the third switching unit when the first output current is zero.

In an embodiment, the power conversion unit comprises a fourth switch, a fifth switch, a resonant circuit, and a second control unit. The fifth switch is connected in series with the fourth switch. The resonant circuit is electrically connected between the fourth switch and the fifth switch. The second control unit is coupled to the fourth switch and the fifth switch configured for generating a third control signal according to a feedback signal. The third control signal is configured for controlling working frequencies or duty cycles of the fourth switch and the fifth switch so as to adjust the output voltage generated by the power conversion unit.

In an embodiment, the first control unit generates the feedback signal according to the first output current and/or the second output current.

In an embodiment, the first control unit turns on the first switching unit when the second control unit turns on the fourth switch. The first control unit turns off the first switching unit and turns on the second switching unit when the first output current reaches a rated current value. The first control unit turns off the second switching unit and the second control unit turns off the fourth switching and turns on the fifth switch when the second output current is zero.

In an embodiment, the first illuminant unit comprises a first light emitting diode string and a first capacitor connected in parallel with the first light emitting diode string. The second illuminant unit comprises a second light emitting diode string and a second capacitor connected in parallel with the second light emitting diode string.

In an embodiment, the light driving circuit comprises a first diode and a second diode. The first diode is connected in series between the first switching unit and the first illuminant unit. The second diode is connected in series between the second switching unit and the second illuminant unit.

In an embodiment, the light driving circuit comprises a first current sampling unit and a second current sampling unit. The first current sampling unit is connected in series with the first switching unit. The second current sampling unit is connected in series with the second switching unit. The first current sampling unit and the second current sampling unit are respectively configured for detecting the first output current and the second output current.

In an embodiment, each of the first current sampling unit and the second current sampling unit is a resistor or a current transformer.

Another aspect of the present disclosure is to provide a light driving circuit. The light driving circuit comprises a first illuminant unit, a second illuminant unit, a power conversion unit, a first switching unit, a second switching unit, and a first control unit. The power conversion unit configured for generating an output voltage. The power conversion unit comprises a primary winding, a first secondary winding, a second secondary winding, and a freewheel unit. The first secondary winding is connected in series with the second secondary winding. The first secondary winding, the second secondary winding, and the primary winding are electrically coupled to each other. The freewheel unit is electrically coupled to the first secondary winding and the second secondary winding. The freewheel unit and second secondary winding co-generate the output voltage. The first switching unit is coupled to the first illuminant unit. The first illuminant unit is driven by the output voltage to emit light and generate a first output current when the first switching unit is turned on. The second switching unit is coupled to the second illuminant unit. The second illuminant unit is driven by the output voltage to emit light and generate a second output current when the second switching unit is turned on. The first control unit is configured for controlling the first switching unit and the second switching unit to be turned on or turned off according to the first output current and the second output current, respectively.

In an embodiment, the power conversion unit comprises a third switching unit and a second control unit. The second control unit is coupled to the third switching unit and is configured for controlling the third switching unit to be turned on or turned off. The power conversion unit generates the output voltage when the second control unit turns off the third switching unit.

In an embodiment, the freewheel unit comprises a fourth switching unit and a capacitor. The fourth switching unit has a first terminal and a second terminal. The first terminal is coupled to the first secondary winding. The capacitor has a first terminal coupled to a second terminal of the fourth switching unit and a second terminal coupled between the first secondary winding and the second secondary winding. A capacitor voltage is formed across the capacitor when the fourth switching unit is turned on.

In an embodiment, the fourth switching unit is turned on when second control unit turns off the third switching unit.

In an embodiment, the fourth switching unit is turned off when the first control unit turns on the first switching unit. The first control unit turns off the first switching unit and turns on the second switching unit when the first output current reaches a rated current value. The first control unit turns off the second switching unit and the second control unit turns on the third switching unit when the second output current is zero.

In an embodiment, the fourth switching unit is turned off when the first control unit turns on the first switching unit and the second switching unit. The first control unit turns off the second switching unit when the second output current reaches a rated current value. The first control unit turns off the first switching unit and the second control unit turns on the third switching unit when the first output current is zero.

In an embodiment, the first control unit turns on the first switching unit and the second switching unit when the second control unit turns off the third switching unit. The first control unit turns off the second switching unit when the second output current reaches a rated current value of the second illuminant unit. The first control unit turns off the first switching unit and the fourth switching unit is turned on when the first output current reaches a rated current value of the first illuminant unit. The second control unit turns on the third switching unit when a current flowing through the first secondary winding is zero.

In an embodiment, the light driving circuit comprises a feedback unit coupled to the freewheel unit. The feedback unit generates a feedback signal according to the capacitor voltage. The second control unit generates a third control signal according to the feedback signal. The third control signal is configured for controlling a duration of an on time of the third switching unit.

In an embodiment, the first control unit turns on the first switching unit and the second switching unit when the second control unit turns off the third switching unit. The first control unit turns off the second switching unit when the second output current reaches a rated current value of the second illuminant unit. The first control unit turns off the first switching unit and the fourth switching unit is turned on when the first output current reaches a rated current value of the first illuminant unit. The feedback unit generates the feedback signal and the second control unit turns on the third switching unit according to the feedback signal when the capacitor voltage is equal to or greater than a predetermined value.

In an embodiment, the feedback unit comprises a photo coupler.

In an embodiment, the first control unit generates a first control signal according to the first output current which is configured for controlling a duration of an on time of the first switching unit, and generates a second control signal according to the second output current which is configured for controlling a duration of an on time of the second switching unit.

In an embodiment, the light driving circuit further comprises a signal synchronizing unit configured for generating a synchronous signal according to a voltage in the first secondary winding and a voltage in the second secondary winding. The synchronous signal is configured for adjusting the first control signal and the second control signal.

In an embodiment, the first control unit compares the first output current with a first reference current to generate a first adjustment signal, and compares the first adjustment signal with the synchronous signal to generate the first control signal, and compares the second output current with a second reference current to generate a second adjustment signal, and compares the second adjustment signal with the synchronous signal to generate the second control signal.

In an embodiment, the power conversion unit further comprises a fifth switch, a sixth switch, a resonant circuit, a third secondary winding, a fourth secondary winding, and a second control unit. The sixth switch is connected in series with the fifth switch. One terminal of the resonant circuit is electrically connected between the fifth switch and the sixth switch. Another terminal of the resonant circuit is electrically connected to the primary winding. The fourth secondary winding is connected in series with the third secondary winding and coupled to the freewheel unit. The fourth secondary winding, the third secondary winding, the first secondary winding, the second secondary winding, and the primary winding being electrically coupled to each other. The second control unit is coupled to the fifth switch and the sixth switch configured for controlling working frequencies or duty cycles of the fifth switch and the sixth switch so as to adjust the output voltage generated by the power conversion unit.

In an embodiment, the freewheel unit comprises a seventh switching unit, an eighth switching unit, a ninth switching unit, a tenth switching unit, and a capacitor. The seventh switching unit has a first terminal and a second terminal. The first terminal is coupled to the first secondary winding. The eighth switching unit has a first terminal coupled to the second secondary winding and a second terminal coupled to the second terminal of the seventh switching unit. The ninth switching unit has a first terminal and a second terminal. The first terminal is coupled to the third secondary winding. The tenth switching unit has a first terminal coupled to the fourth secondary winding and a second terminal coupled to the second terminal of the ninth switching unit. The capacitor has a first terminal coupled to the second terminals of the seventh switching unit and the eighth switching unit and a second terminal coupled to the second terminals of the ninth switching unit and the tenth switching unit.

Another aspect of the present disclosure is to provide a light driving circuit. The light driving circuit comprises a first illuminant unit, a second illuminant unit, a power conversion unit, a first switching unit, a second switching unit, and a first control unit. The power conversion unit is configured for generating an output voltage. The power conversion unit comprises a primary winding, a first secondary winding, a second secondary winding, and a freewheel unit. The first secondary winding, the second secondary winding, and the primary winding are electrically coupled to each other. The first secondary winding is isolated from the second secondary winding. The freewheel unit is electrically coupled to the first secondary winding. The second secondary winding generates the output voltage. The first switching unit is coupled to the first illuminant unit. The first illuminant unit is driven by the output voltage to emit light and generate a first output current when the first switching unit is turned on. The second switching unit is coupled to the second illuminant unit. The second illuminant unit is driven by the output voltage to emit light and generate a second output current when the second switching unit is turned on. The first control unit is configured for controlling the first switching unit and the second switching unit to be turned on or turned off according to the first output current and the second output current, respectively.

It is to be understood that both an embodiment general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
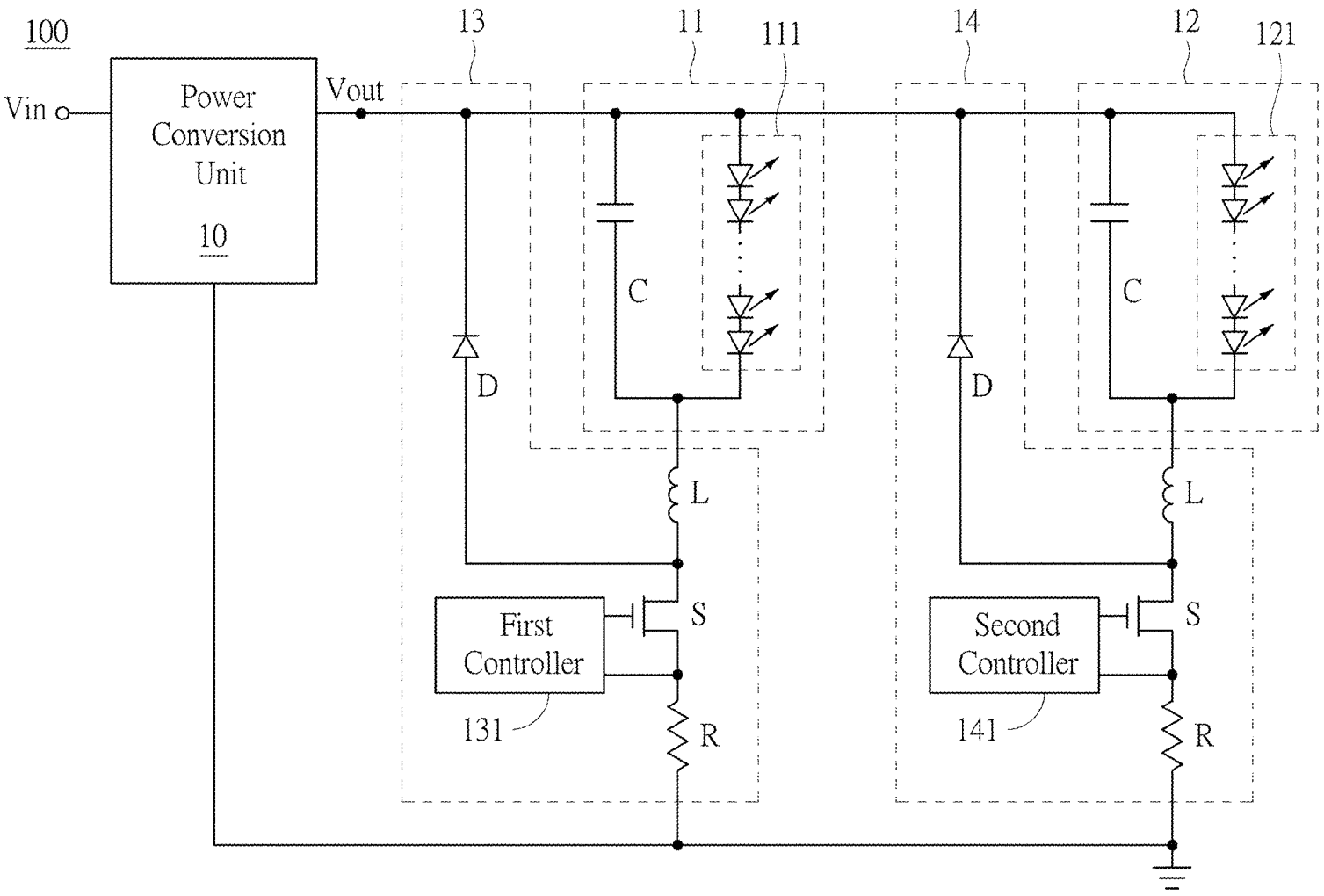
FIG. 1 depicts a schematic diagram of a driving circuit for driving a plurality of light emitting diode strings according to the prior art.

Reference will now be made in detail to the present embodiments of the disclosure, examples of which are illustrated in the accompanying drawings. Wherever possible, the same reference numbers are configured in the drawings and the description to refer to the same or like parts.

Figure 2:
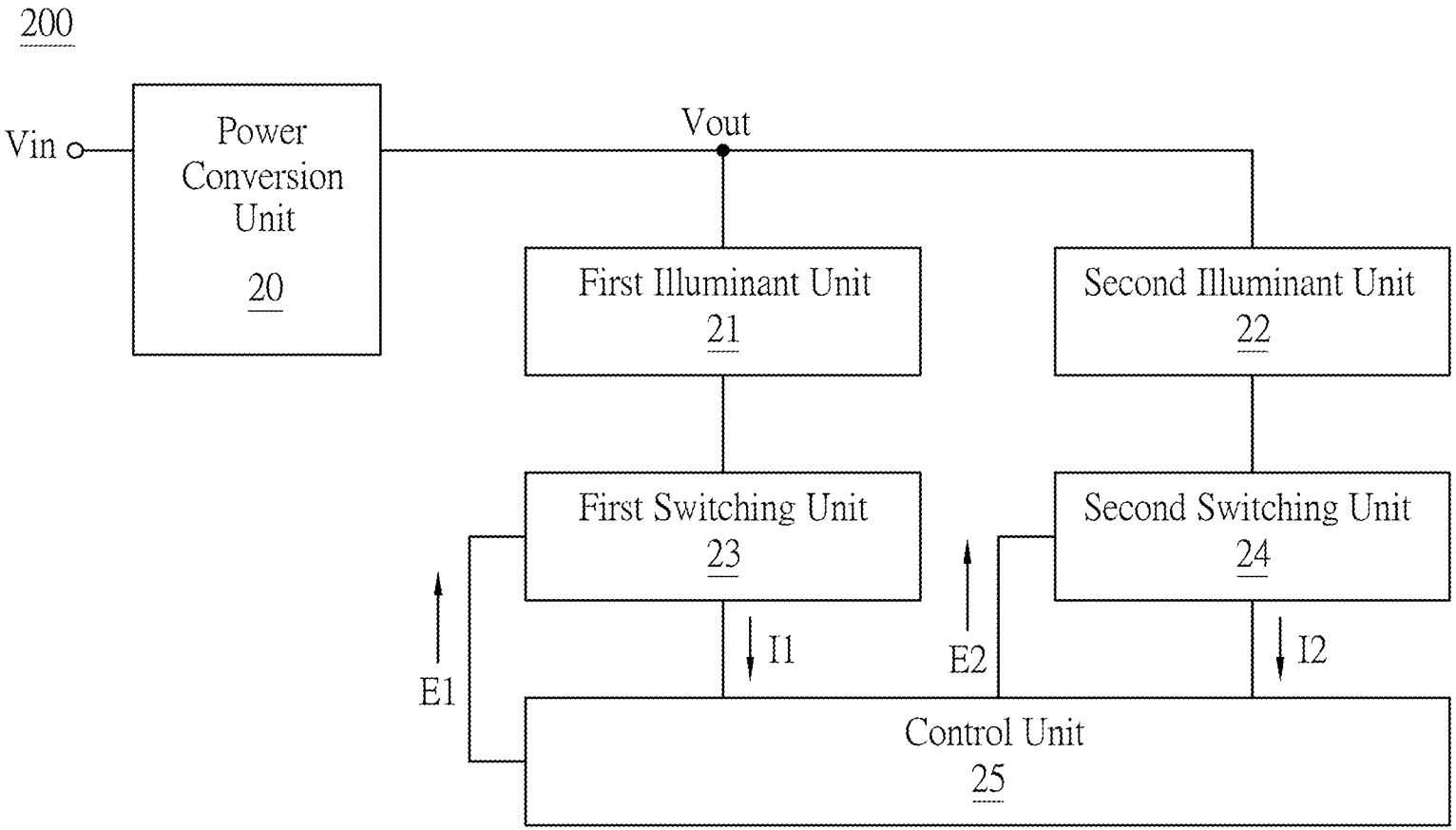
FIG. 2 depicts a block diagram of a light driving circuit according to one embodiment of this disclosure.

FIG. 2 depicts a block diagram of a light driving circuit 200 according to one embodiment of this disclosure. As shown in FIG. 2, a light driving circuit 200 comprises a power conversion unit 20, a first illuminant unit 21, a second illuminant unit 22, a first switching unit 23, a second switching unit 24, and a control unit 25. In the present embodiment, although the light driving circuit 200 for driving two illuminant units serves as an example for explanation of aspects of the present disclosure, the number of illuminant units to be driven may be determined depending on actual circuits, and the present embodiment is not limited in this regard.

The power conversion unit 20 receives an input voltage Vin from external and converts the input voltage Vin into an output voltage Vout so as to drive the first illuminant unit 21 and the second illuminant unit 22. The power conversion unit 20 may comprise any type of DC/DC converter, such as a flyback converter, a forward converter, a push-pull converter, an LLC resonant converter, a half-bridge converter, a full-bridge converter, or a half-bridge LLC (HBLLC) converter, but the present embodiment is not limited in this regard.

The first switching unit 23 and the second switching unit 24 are respectively coupled to the first illuminant unit 21 and the second illuminant unit 22. When the first switching unit 23 is turned on, the first illuminant unit 21 is driven by the output voltage Vout generated by the power conversion unit 20 to emit light and generate a first output current I1 to the control unit 25. Similarly, when the second switching unit 24 is turned on, the second illuminant unit 22 is driven by the output voltage Vout generated by the power conversion unit 20 to emit light and generate a second output current I2 to the control unit 25. The control unit 25 controls the first switching unit 23 and the second switching unit 24 to be turned on and turned off respectively according to the first output current I1 and the second output current I2.

With respect to one operation, the power conversion unit 20 receives the input voltage Vin and converts the input voltage Vin into the output voltage Vout. At this time, both the first switching unit 23 and the second switching unit 24 are not turned on. Then, at a first time, the control unit 25 turns on the first switching unit 23 so that the first illuminant unit 21 is driven by the output voltage Vout to emit light and generate the first output current I1. After that, when the first output current I1 reaches a first rated current value, the control unit 25 turns off the first switching unit 23 and turns on the second switching unit 24 so that the second illuminant unit 22 is driven by the output voltage Vout to emit light and generate the second output current I2. The first rated current value is equal to an average current value required by the first illuminant unit 21 for maintaining its rated duty.

It is noted that the first time denotes the time at which the power conversion unit 20 outputs the electrical energy for driving the first illuminant unit 21 and/or the second illuminant unit 22 to emit light. For example, when the power conversion unit 20 comprises a flyback converter, the first time may be the time at which the switching unit in the primary circuit of the flyback converter is turned off. That is, the time at which the primary circuit provides electrical energy to the secondary circuit of the flyback converter. Similarly, when the power conversion unit 20 comprises one selected from a group consisting of the forward converter, the push-pull converter, the LLC resonant converter, the half-bridge converter, a full-bridge converter, and the half-bridge LLC converter, the first time denotes the time at which the above converters start to provide electrical energy to the illuminant unit.

With respect to another operation, it is assumed that a voltage for driving the first illuminant unit 21 is greater than a voltage for driving the second illuminant unit 22. The power conversion unit 20 receives the input voltage Vin and converts the input voltage Vin into the output voltage Vout. At this time, both the first switching unit 23 and the second switching unit 24 are not turned on. Then, at the first time, the control unit 25 turns on the first switching unit 23 and the second switching unit 24. Since the voltage for driving the first illuminant unit 21 is greater than the voltage for driving the second illuminant unit 22, the second illuminant unit 22 is first driven by the output voltage Vout to emit light and generate the second output current I2. After that, when the second output current I2 reaches a second rated current value, the control unit 25 turns off the second switching unit 24. The first illuminant unit 21 is thereafter driven by the by the output voltage Vout to emit light and generate the first output current I1. The second rated current value is equal to an average current value required by the second illuminant unit 22 for maintaining its rated duty.

In addition, the control unit 25 further adjusts an on time of the first switching unit 23 according to a magnitude of the first output current I1 so as to adjust an average current flowing through the first illuminant unit 11. Similarly, the control unit 25 also adjusts an on time of the second switching unit 24 according to a magnitude of the second output current I2 so as to adjust an average current flowing through the second illuminant unit 22.

In more detail, the control unit 25 receives the first output current I1 and compares the first output current I1 with a first reference current To generate a first control signal E1. The first control signal E1 is configured for controlling a duration of the on time of the first switching unit 23. The first control signal E1 may be a pulse width modulation (PWM) signal. When the first output current I1 is greater than the first reference current, the control unit 25 can decrease a duty cycle of the first control signal E1 so as to decrease the on time of the first switching unit 23. Hence, the average current flowing through the first illuminant unit 21 is adjusted. Similarly, the control unit 25 also receives the second output current I2 and compares the second output current I2 with a second reference current to generate a second control signal E2. The second control signal E2 is configured for controlling the on time of the second switching unit 24 so as to adjust the average current flowing through the second illuminant unit 22.

In this manner, by controlling the on time and off time of each of the switching units, the light driving circuit 200 is capable of independently controlling each of the illuminant units through a control unit without the disposition of extra buck converters corresponding to the illuminant units.

Figure 3A:
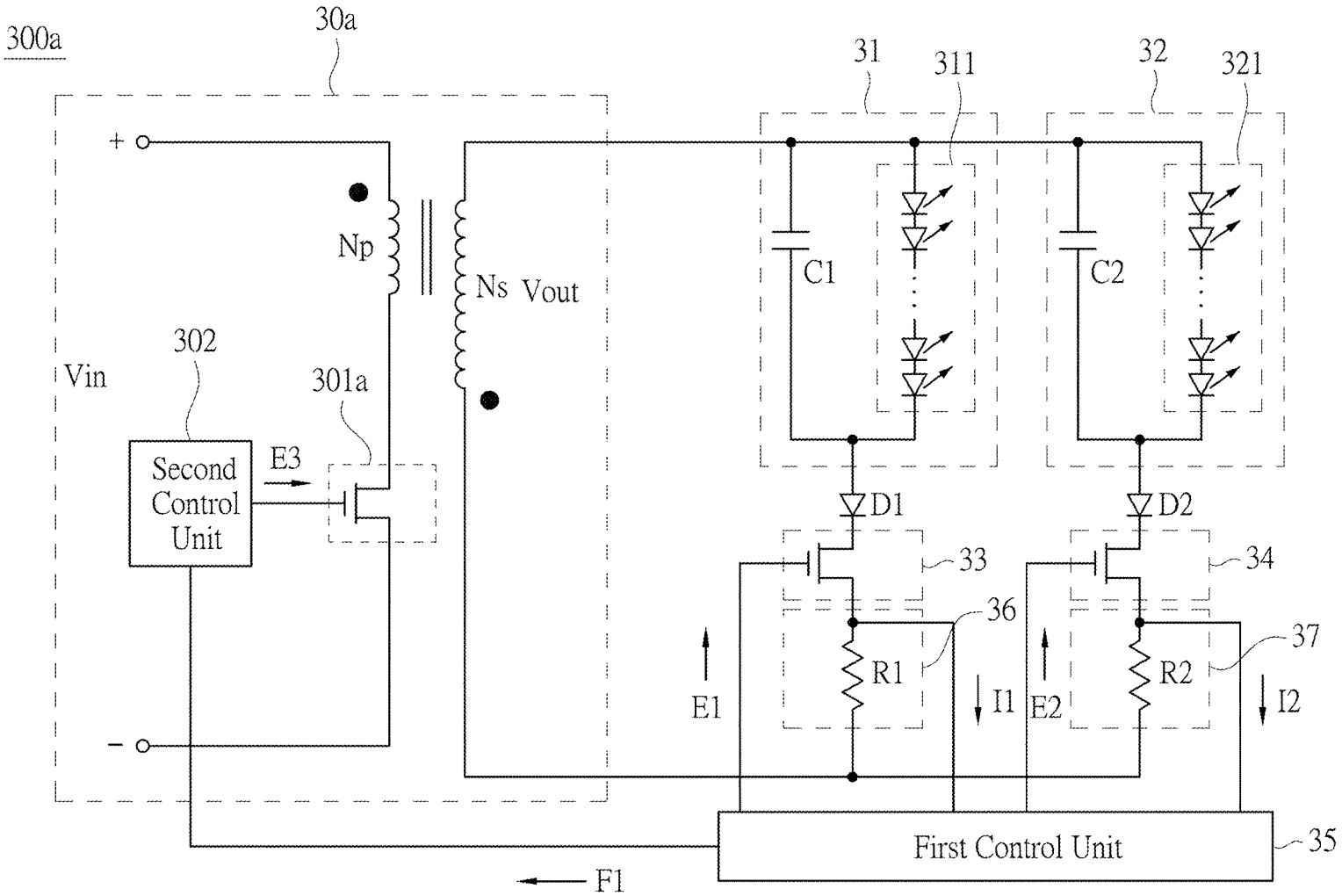
FIG. 3*a* depicts a circuit diagram of a light driving circuit according to one embodiment of this disclosure.

FIG. 3*a* depicts a circuit diagram of a light driving circuit 300*a* according to one embodiment of this disclosure. The light driving circuit 300*a* comprises a power conversion unit 30*a*, a first illuminant unit 31, a second illuminant unit 32, a first switching unit 33, a second switching unit 34, and a first control unit 35. In the present embodiment, the power conversion unit 30*a* may comprise a flyback converter, but the present disclosure is not limited in this regard.

In addition, the power conversion unit 30*a* further comprises a third switching unit 301*a* and a second control unit 302. The third switching unit 301*a* is coupled to a primary winding Np of the power conversion unit 30*a*. The power conversion unit 30*a* receives an input voltage Vin and converts the input voltage Vin into an output voltage Vout. In greater detail, since the power conversion unit 30*a* is the flyback converter, the power conversion unit 30*a* starts to receive the input voltage Vin and generate a current in the primary winding Np of a transformer when the third switching unit 301*a* is turned on according to the present embodiment. The power conversion unit 30*a* stores the received input voltage Vin in the primary winding Np. Up to this time, no output current has been generated in a secondary winding Ns of the transformer yet. Then, when the third switching unit 301*a* is turned off, the power conversion unit 30*a* starts to convert the input voltage Vin into the output voltage Vout and generate a current in the secondary winding Ns of the transformer. Additionally, the second control unit 302 may be configured for controlling the third switching unit 301*a* to be turned on and turned off so as to adjust a magnitude of the output voltage Vout generated by the power conversion unit 30*a*.

The first illuminant unit 31 comprises a first light emitting diode string 311 and a capacitor C1 connected in parallel with the first light emitting diode string 311. The second illuminant unit 32 comprises a second light emitting diode string 321 and a capacitor C2 connected in parallel with the second light emitting diode string 321. In the present embodiment, a number of the light emitting diode strings driven by the light driving circuit 300*a* is two, however the number of the light emitting diode strings may be determined depending on actual designs and may be any numerical value equal to or greater than one, and the present embodiment is not limited in this regard.

The light driving circuit 300*a* comprises a first diode D1 and a second diode D2. The first diode D1 is coupled between the first illuminant unit 31 and the first switching unit 33. An anode of the first diode D1 and an anode of the first light emitting diode string 311 are disposed in the same polarity direction. The second diode D2 is coupled between the second illuminant unit 32 and the second switching unit 34. An anode of the second diode D2 and an anode of the second light emitting diode string 321 are disposed in the same polarity direction. In addition to that, the light driving circuit 300*a* further comprises a first current sampling unit 36 and a second current sampling unit 37. The first current sampling unit 36 and the second current sampling unit 37 are respectively connected in series with the first switching unit 33 and the second switching unit 34, and are respectively configured for detecting and sampling a first output current I1 and a second output current I2. Each of the first current sampling unit 36 and the second current sampling unit 37 may be a device, such as a resistor or a current transformer. According to the present embodiment, the first current sampling unit 36 and the second current sampling unit 37 are respectively a resistor R1 and a resistor R2, but the present embodiment is not limited in this regard.

When the first switching unit 33 is turned on, the first diode D1 is turned on. At this time, the first light emitting diode string 311 is driven by the output voltage Vout to emit light and generate the first output current I1. The first current sampling unit 36 is configured for sampling the first output current I1 and outputting the first output current I1 to the first control unit 35. The first control unit 35 generates a first control signal E1 according to the first output current I1. The first control signal E1 is configured for adjusting a duration of an on time of the first switching unit 33. Similarly, when the second switching unit 34 is turned on, the second diode D2 is forward biased and turned on. The second light emitting diode string 321 is driven by the output voltage Vout to emit light and generate the second output current I2. The second current sampling unit 37 is configured for sampling the second output current I2 and outputting the second output current I2 to the first control unit 35. The first control unit 35 generates a second control signal E2 according to the second output current I2. The second control signal E2 is configured for adjusting a duration of an on time of the second switching unit 34.

The first control unit 35 not only controls the first switching unit 33 and the second switching unit 34 to be turned on and turned off, but also generates a feedback signal F1 to the second control unit 302 according to the first output current I1 and/or the second output current I2. The second control unit 302 may generate a third control signal E3 according to the feedback signal F1. The third control signal E3 is configured for controlling a duration of an on time of the third switching unit 301*a*.

In more detail, the third control signal E3 may also be a PWM signal. In this manner, the first control unit 35 may generate the proper feedback signal F1 according to magnitudes of the first output current I1 and/or the second output current I2. After that, the second control unit 302 generates the third control signal E3 according to the feedback signal F1. The second control unit 302 turns off the third switching unit 301*a* according to the third control signal E3 to allow the power conversion unit 30*a* to generate the output voltage Vout so as to drive the first illuminant unit 31 and the second illuminant unit 32.

In one embodiment, the process that the first control unit 35 generates the feedback signal F1 to the second control unit 302 may be realized by implementation of a photo coupler (not shown in the figure), but the present embodiment is not limited in this regard. The photo coupler comprises a light emitting device and a light receiving device. The first control unit 35 may generate a signal according to the first output current I1 and/or the second output current I2 and input the signal to the light emitting device of the photo coupler. The light emitting device then emits an optical signal which is received by the light receiving device of the photo coupler. The light receiving device thereafter converts the optical signal into an electrical signal and outputs the electrical signal to the second control unit 302.

Figure 3B:
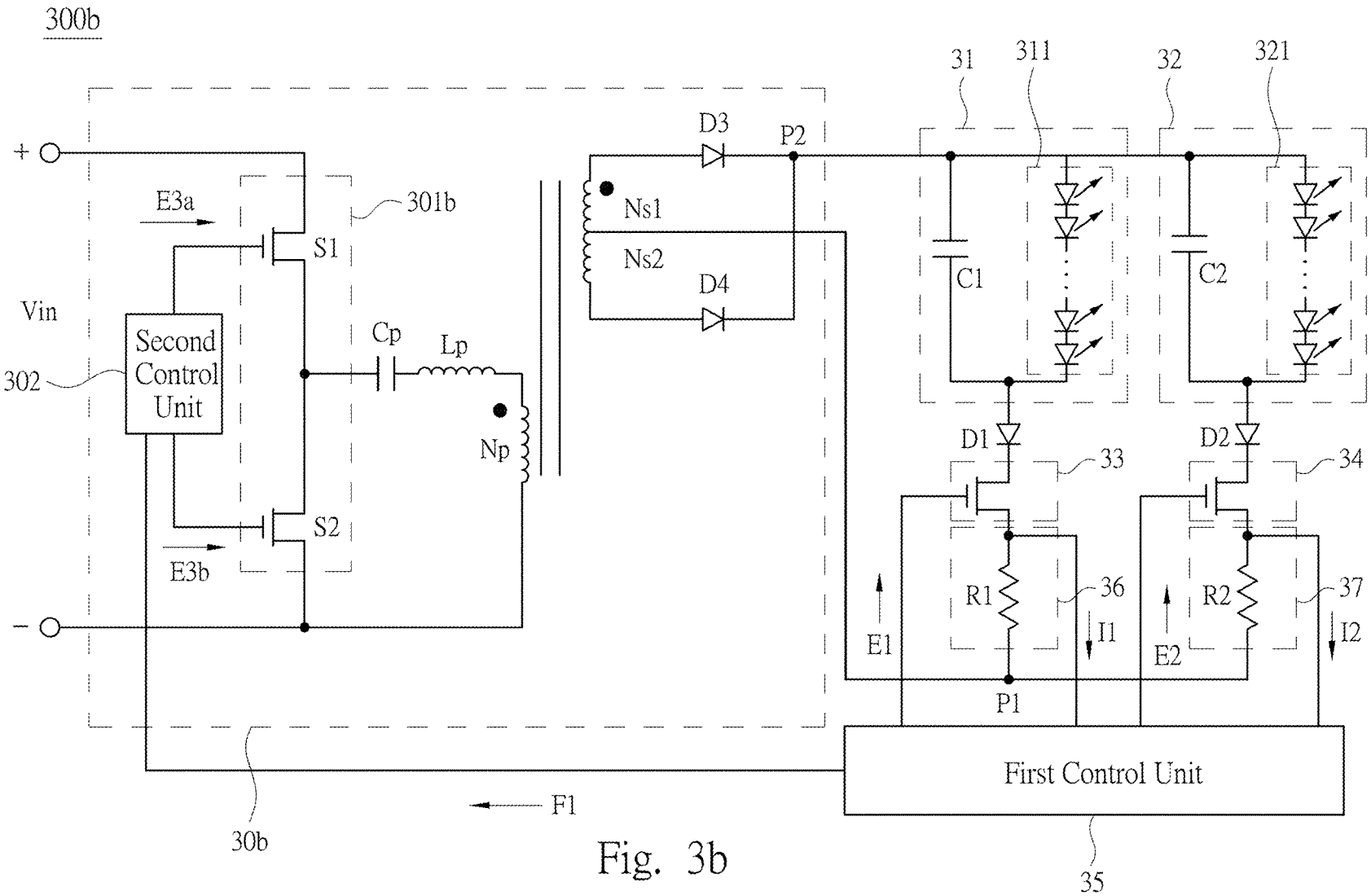
FIG. 3*b* depicts a circuit diagram of a light driving circuit according to another embodiment of this disclosure.

FIG. 3*b* depicts a circuit diagram of a light driving circuit 300*b* according to another embodiment of this disclosure. Similarly, the light driving circuit 300*b* comprises a power conversion unit 30*b*, the first illuminant unit 31, the second illuminant unit 32, the first switching unit 33, the second switching unit 34, the first control unit 35, the first current sampling unit 36, and the second current sampling unit 37. In the present embodiment, the power conversion unit 30*b* may comprise an LLC resonant converter. In greater detail, the power conversion unit 30*b* comprises a fourth switch S1, a fifth switch S2, a resonant circuit, and the second control unit 302. The resonant circuit has a resonant capacitor Cp and a resonant inductor Lp. The resonant capacitor Cp and the resonant inductor Lp are connected in series with a primary winding Np of a transformer in the power conversion unit 30*b*.

In addition, the fourth switch S1 and the fifth switch S2 are connected in series to form a half bridge circuit. The half bridge circuit is connected in parallel with a single input voltage Vin. One terminal of the resonant capacitor Cp of the resonant circuit is electrically connected between the fourth switch S1 and the fifth switch S2. Additionally, the fourth switch S1 and the fifth switch S2 may also be respectively connected to other switching devices to form a full bridge circuit, and the present embodiment is not limited in this regard. In addition to that, the second control unit 302 is coupled to the fourth switch S1 and the fifth switch S2, and generates a control signal E3*a* and a control signal E3*b* so as to respectively control working frequencies or duty cycles of the fourth switch S1 and the fifth switch S2. An output voltage Vout generated by the power conversion unit 30*b* is thus adjusted. In addition, a secondary winding of the transformer in the power conversion unit 30*b* is a center-tapped winding. That is, the secondary winding comprises a first secondary winding Ns1 and a second secondary winding Ns2. The first secondary winding Ns1 and the second secondary winding Ns2 are electrically connected to a connection point P1 through center tapping. The first secondary winding Ns1 and the second secondary winding Ns2 are respectively coupled to anodes of a diode D3 and a diode D4, Cathodes of the diode D3 and the diode D4 are electrically connected to a connection point P2, The first illuminant unit 31 and the second illuminant unit 32 are electrically coupled between the connection point P1 and the connection point P2. Since the connections and operations of the other units are similar to the connections and operations described in the above embodiment, a description in this regard is not provided.

Similarly, in the present embodiment, the first control unit 35 may generate a feedback signal F1 according to magnitudes of a first output current I1 and/or a second output current I2. The second control unit 302 may generate a third control signal E3*a* and a third control signal E3*b* according to the feedback signal F1. The third control signal E3*a* and the third control signal E3*b* are respectively configured for controlling durations of on times of the fourth switch S1 and the fifth switch S2. In one embodiment, both the third control signals E3*a*, E3*b* may be PWM signals configured for respectively controlling the duty cycles of the fourth switch S1 and the fifth switch S2 so that the power conversion unit 30*b* is allowed to provide the sufficient output voltage Vout to drive the first illuminant unit 31 and the second illuminant unit 32. In another embodiment, the third control signals E3*a*, E3*b* may be pulse frequency modulation (PFM) signals configured for respectively controlling switching frequencies of the fourth switch S1 and the fifth switch S2 so that the power conversion unit 30*b* is allowed to provide the sufficient output voltage Vout to drive the first illuminant unit 31 and the second illuminant unit 32.

Figure 4A:
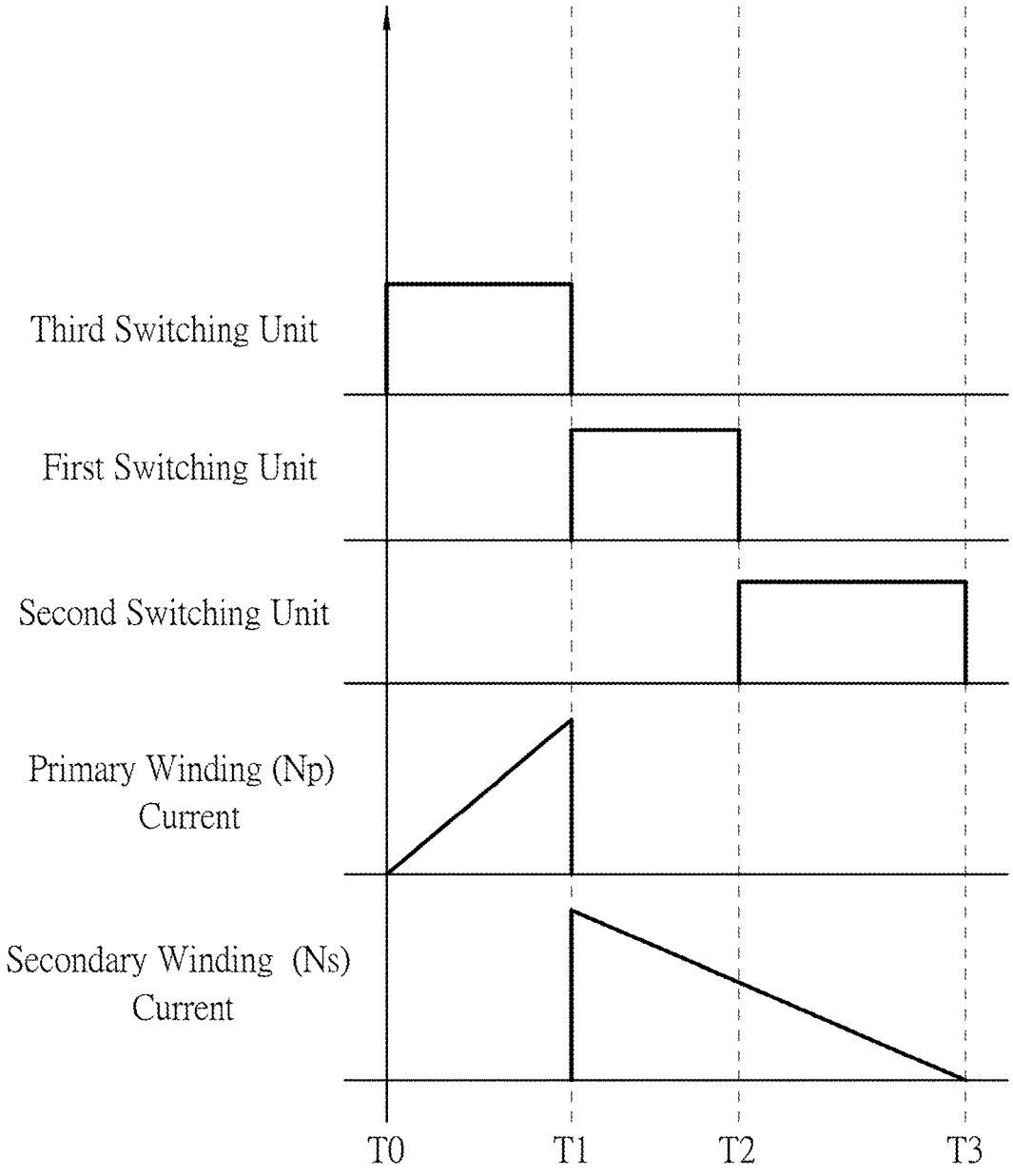
FIG. 4*a* depicts a control timing diagram for according to one embodiment of this disclosure.

To simplify and clarify matters, a description is provided with reference to FIG. 3*a* and FIG. 4*a*. FIG. 4*a* depicts a control timing diagram according to one embodiment of this disclosure. In the present embodiment, the light driving circuit 300*a* shown in FIG. 3*a* is taken as an example, but the present embodiment is not limited to this.

As shown in FIG. 4*a*, at time T0, the second control unit 302 turns on the third switching unit 301*a*. At this time, the power conversion unit 30*a* receives the input voltage Vin and generates the current in the primary winding Np of the transformer. Input electrical energy thus received is stored in the primary winding Np. Up to this time, the output current has not yet been generated in the secondary winding Ns since both the first switching unit 33 and the second switching unit 34 are not turned on.

Then, at time T1, the second control unit 302 turns off the third switching unit 301*a*. The output voltage Vout generated by the power conversion unit 30*a* is sufficient to drive the first illuminant unit 31 and the second illuminant unit 32. At this time, the first control unit 35 turns on the first switching unit 33. The output voltage Vout and the current stored in the secondary winding Ns drive the first illuminant unit 31 to emit light, and the first output current I1 is generated through the first illuminant unit 31. In addition, the first control unit 35 detects the first output current I1 and adjusts the duration of the on time of the first switching unit 33 according to the magnitude of the first output current I1, that is, a period between the time T1 and a time T2. Hence, the power conversion unit 301 is able to provide sufficient power to drive the first illuminant unit 31.

After that, at the time T2, the first illuminant unit 31 has acquired the sufficient power to maintain its rated duty. That is, the first output current I1 has reached a first rated current value. The first rated current value is equal to an average current value required by the first illuminant unit 31 for maintaining its rated duty. At this time, the first control unit 35 turns off the first switching unit 33 and turns on the second switching unit 34. The output voltage Vout stored in the secondary winding Ns is changed to drive the second illuminant unit 32 to emit light and generates the second output current I2 through the second illuminant unit 32. Similarly, the first control unit 35 detects the second output current I2 and adjusts the duration of the on time of the second switching unit 34 according to the magnitude of the second output current I2.

At time T3, when the first control unit 35 detects that the second output current I2 is zero, the current in the secondary winding Ns is also zero. The first control unit 35 controls the second switching unit 34 to turn off, and the first control unit 35 can generate the feedback signal F1 according to the second output current I2. The second control unit 302 generates the third control signal E3 according to the feedback signal F1 so as to control the third switching unit 301*a* to be turned on. That is, the operation comes back to the time T0. In this manner, the operation of controlling the light driving circuit 300*a* is completed.

In addition, at the time T3, the first control unit 35 can detect the first output current I1 and/or the second output current I2 and generate the feedback signal F1 to the second control unit 302 according to the first output current I1 and/or the second output current I2. The second control unit 302 generates the third control signal E3 according to the feedback signal F1. The third control signal E3 is configured for adjusting the duration of the on time of the third switching unit 301*a* to ensure that the power conversion unit 30*a* is able to provide the sufficient power to drive the first illuminant unit 31 and the second illuminant unit 32. Therefore, the light driving circuit 300*a* can adjust the average current flowing through each of the illuminant units (such as the first illuminant unit 31 and the second illuminant unit 32)

through the first control unit 35 so as to independently drive the illuminant units. Additionally, the light driving circuit 300*a* can further adjust the output voltage Vout converted by the power conversion unit 30*a* through the second control unit 302 to allow the power conversion unit 30*a* to provide the sufficient power to drive each of the illuminant units.

Figure 4B:
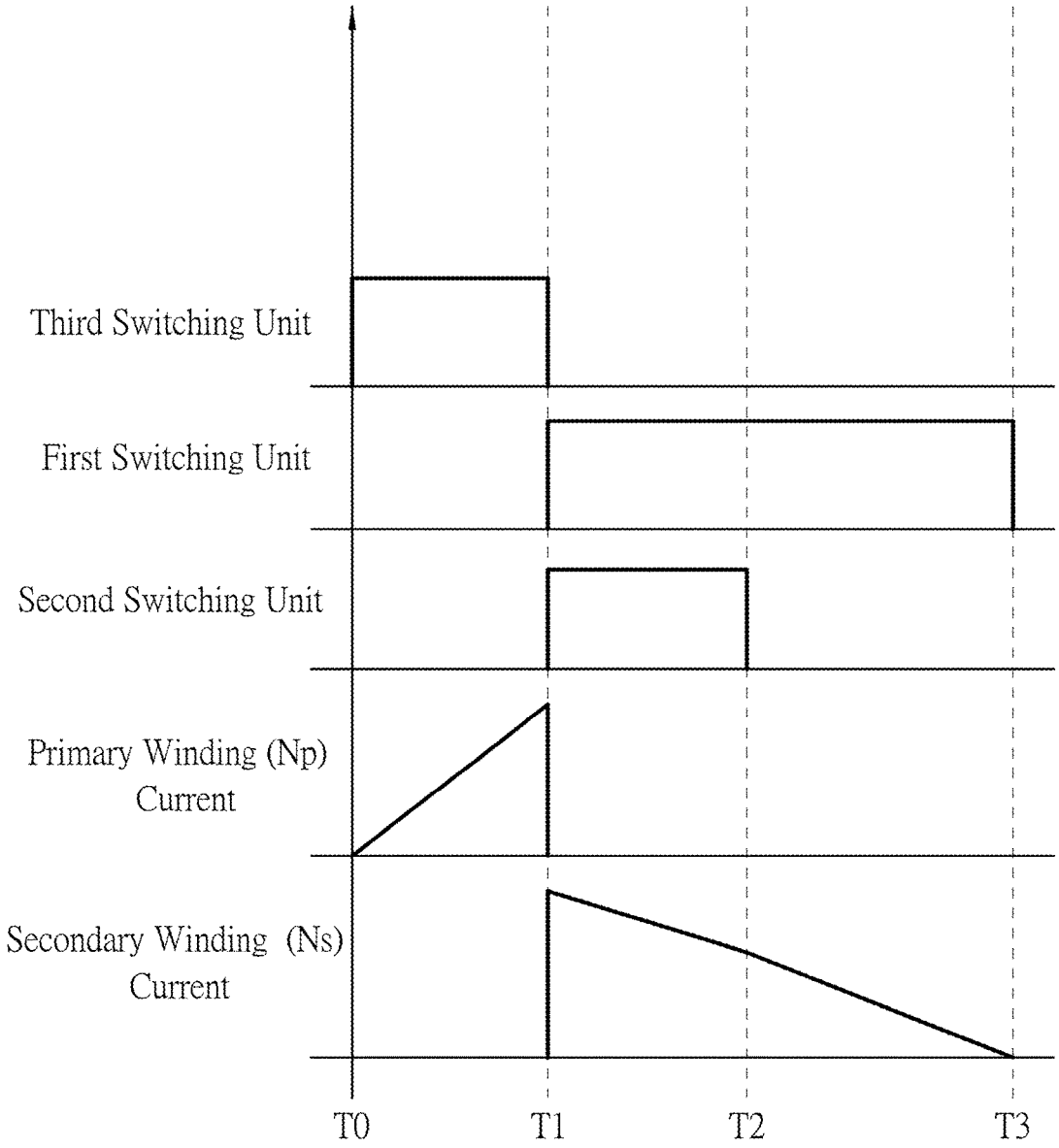
FIG. 4*b* depicts a control timing diagram according to another embodiment of this disclosure.

Besides the method for controlling the light driving circuit provided in FIG. 4*a*, the present disclosure further provides another method for controlling the light driving circuit. A description is provided with reference to FIG. 3*a* and FIG. 4*b*. FIG. 4*b* depicts a control timing diagram according to another embodiment of this disclosure. In the present embodiment, it is assumed that a driving voltage required by the first light emitting diode string 311 is greater than a driving voltage required by the second light emitting diode string 321 in the light driving circuit 300*a*.

As shown in FIG. 4*b*, at time T0, the second control unit 302 turns on the third switching unit 301*a*. At this time, the power conversion unit 30*a* starts to receive the input voltage Vin and generates the current in the primary winding Np of the transformer. Input electrical energy thus received is stored in the primary winding Np. Up to this time, both the first switching unit 33 and the second switching unit 34 have not been turned on yet and the output current has not yet been generated in the secondary winding Ns.

Then, at time T1, the second control unit 302 turns off the third switching unit 301*a*. The output voltage Vout generated by the power conversion unit 30*a* is sufficient to drive the first illuminant unit 31 and the second illuminant unit 32. At this time, the first control unit 35 turns on the first switching unit 33 and the second switching unit 34 simultaneously. Since the driving voltage required by the second light emitting diode string 321 is smaller than the driving voltage required by the first light emitting diode string 311, the second illuminant unit 32 is first driven to emit light by the output voltage Vout stored in the secondary winding Ns and generate the second output current I2. At this time, the first control unit 35 detects the second output current I2 and adjusts the duration of the on time of the second switching unit 34 according to the magnitude of the second output current I2, that is, a period between the time T1 and a time T2, Hence, the power conversion unit 30*a* is able to provide sufficient power to drive the second illuminant unit 32.

After that, at the time T2, the second illuminant unit 32 has acquired the sufficient power to maintain its rated duty. That is, the second output current I2 has reached a second rated current value. The second rated current value is equal to an average current value required by the second illuminant unit 32 for maintaining its rated duty. At this time, the first control unit 35 turns off the second switching unit 34. The output voltage Vout is changed to drive the first illuminant unit 31. The first illuminant unit 31 is driven to emit light and generate the first output current I1. Similarly, the first control unit 35 detects the first output current I1 and adjusts the duration of the on time of the first switching unit 33 according to the magnitude of the first output current I1.

At time T3, when the first control unit 35 detects that the first output current I1 is zero, the output current in the secondary winding Ns is also zero. The first control unit 35 controls the first switching unit 33 to turn off, and the first control unit 35 can generate the feedback signal F1 according to the first output current I1. The second control unit 302 generates the third control signal E3 according to the feedback signal F1 so as to control the third switching unit 301*a* to be turned on. That is, the operation comes back to the time T0. In this manner, the operation of controlling the light driving circuit 300*a* is completed.

Similarly, at the time T3, the first control unit 35 detects the first output current I1 and/or the second output current I2 and generates the feedback signal F1 to the second control unit 302 according to the first output current I1 and/or the second output current I2. The second control unit 302 adjusts the duration of the on time of the third switching unit 301*a* according to the feedback signal F1 to ensure that the power conversion unit 30*a* is able to provide the sufficient power to drive the first illuminant unit 31 and the second illuminant unit 32. In the present embodiment, the method for controlling the light driving circuit 300*a* is more direct, which in turn reduces the design complexity in the first control unit 35 and increases the operational stability of the of the light driving circuit 300*a*.

Figure 4C:
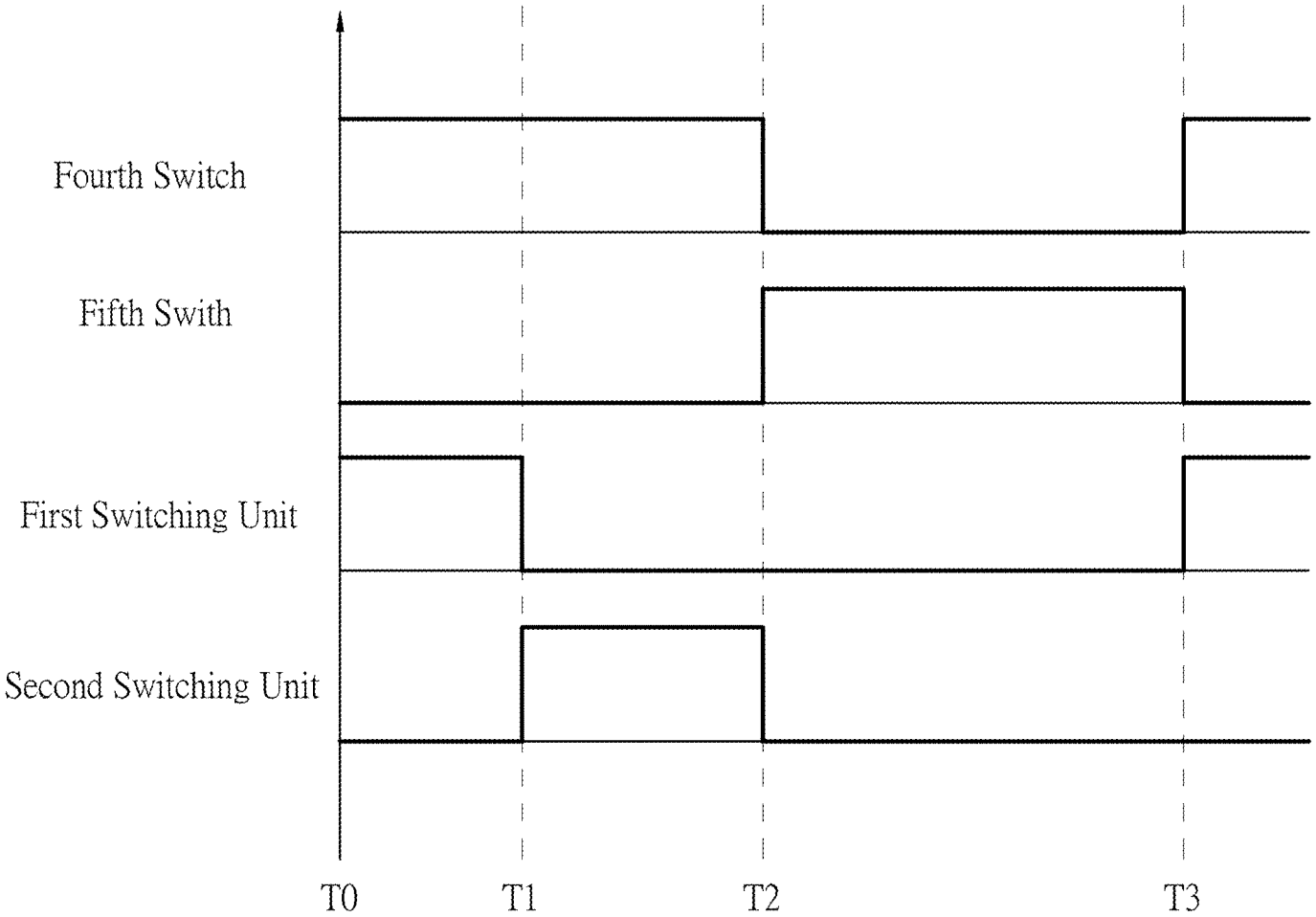
FIG. 4*c* depicts a control timing diagram according to still another embodiment of this disclosure.

In one embodiment, the control methods provided in the embodiments shown in FIG. 4*a* and FIG. 4*b* may be applied to the light driving circuit 300*a* shown in FIG. 3*a*. In addition, the present disclosure further provides another method for controlling a light driving circuit that is applied to the light driving circuit 300*b* shown in FIG. 3*b*. A description is provided with reference to FIG. 3*b* and FIG. 4*c*. FIG. 4*c* depicts a control timing diagram according to still another embodiment of this disclosure.

As shown in FIG. 4*c*, at time T0, the second control unit 302 first controls the fourth switch S1 to turn on. However, in other embodiments, the second control unit 302 may first control the fifth switch S2 to turn on, but the present embodiment is not limited in this regard. The fourth switch S1 and the fifth switch S2 are turned on alternately. In the present embodiment, when the second control unit 302 controls the fourth switch S1 to turn on, the power conversion unit 30*b* starts to receive the input voltage Vin and at the same time the first control unit 35 controls the first switching unit 33 to turn on. Hence, the first illuminant unit 31 is driven by the output voltage Vout output from the power conversion unit 30*b* to emit light and generates the first output current I1. Additionally, the first control unit 35 detects the first output current I1 and adjusts the duration of the on time of the first switching unit 33 according to the magnitude of the first output current I1, that is, a period between the time T0 and a time T1. In this manner, the power conversion unit 30*b* is able to provide sufficient power to drive the first illuminant unit 31.

Then, at the time T1, the first illuminant unit 31 has acquired the sufficient power to maintain its rated duty. That is, the first output current I1 has reached the first rated current value. The first rated current value is equal to an average current value required by the first illuminant unit 31 for maintaining its rated duty. At this time, the first control unit 35 turns off the first switching unit 33 and turns on the second switching unit 34. The output voltage Vout output from the power conversion unit 30*b* is changed to drive the second illuminant unit 32 to emit light and generate the second output current I2 through the second illuminant unit 32. Similarly, the first control unit 35 detects the second output current I2 and adjusts the duration of the on time of the second switching unit 34 according to the magnitude of the second output current I2.

After that, at time T2, the first control unit 35 detects that the second output current I2 is zero. At this time, the output currents in the first secondary winding Ns1 and/or the second secondary winding Ns2 are also zero. The first control unit 35 turns off the second switching unit 34. The first control unit 35 can generate the feedback signal F1 according to the second output current I2. At this time, the second control unit 302 can generate the third control signal E3*a* and the third control signal E3*b* according to the feedback signal F1. The third control signal E3*a* controls the fourth switch S1 to turn off, and the third control signal E3*b* controls the fifth switch S2 to turn on. Since the circuit shown in FIG. 3 is a full wave circuit, the second control unit 302 controls the fourth switch S1 to turn off and controls the fifth switch S2 to turn on during a period between the time T2 and a time T3. In other words, the first control unit 35 turns on the first switching unit 33 and the second switching unit 34 in sequence between the time T2 and a time T3. The time sequence may be the same as that during a period between the time T0 and the time T2, and a description in this regard is not provided.

Then, at the time T3, the second control unit 302 controls the fourth switch S1 to turn on and at the same time controls the fifth switch S2 to turn off. That is, the operation comes back to the time T0. In this manner, the operation of controlling the light driving circuit 300*b* is completed.

Similarly, at the time T2, the first control unit 35 detects the first output current I1 and/or the second output current I2 and generates the feedback signal F1 to the second control unit 302 according to the first output current I1 and/or the second output current I2. The second control unit 302 adjusts the durations of the on times of the fourth switch S1 and the fifth switch S2 according to the feedback signal F1 to ensure that the power conversion unit 30*b* is able to provide the sufficient power to drive the first illuminant unit 31 and the second illuminant unit 32

Figure 5A:
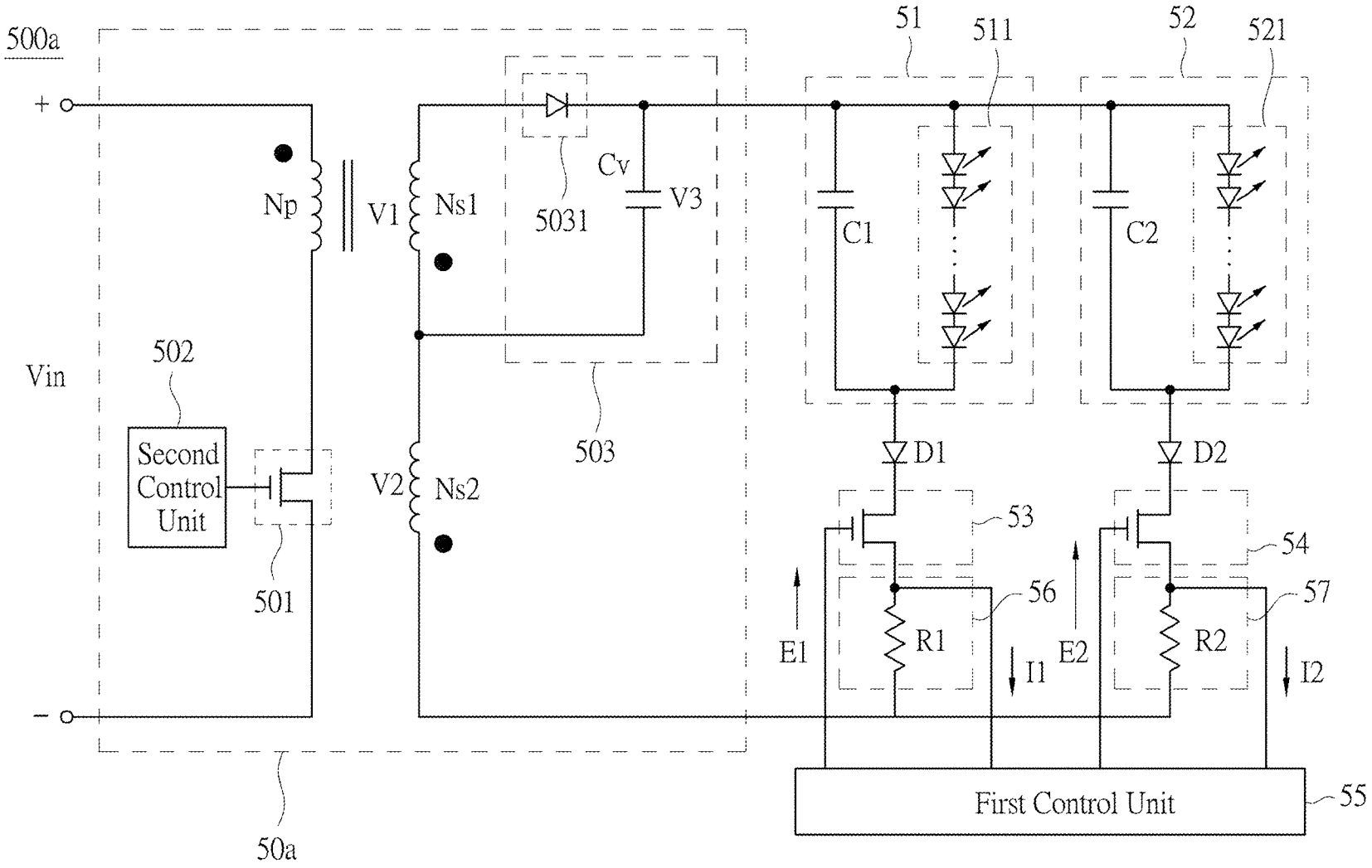
FIG. 5*a* depicts a circuit diagram of a light driving circuit according to still another embodiment of this disclosure.

FIG. 5*a* depicts a circuit diagram of a light driving circuit 500*a* according to still another embodiment of this disclosure. As shown in FIG. 5*a*, the light driving circuit 500*a* comprises a power conversion unit 50*a*, a first illuminant unit 51, a second illuminant unit 52, a first switching unit 53, a second switching unit 54, a first control unit 55, a first current sampling unit 56, and a second current sampling unit 57. Similarly, the power conversion unit 50*a* may be any type of DC/DC converter, such as a flyback converter, a forward converter, a push-pull converter, an LLC resonant converter, a half-bridge converter, a full-bridge converter, or a half-bridge LLC (HBLLC) converter, but the present embodiment is not limited in this regard. In the present embodiment, the power conversion unit 50*a* may be a flyback converter, but the present embodiment is not limited in this regard.

The power conversion unit 50*a* comprises a primary winding Np, a first secondary winding Ns1, a second secondary winding Ns2, a third switching unit 501, a second control unit 502, and a freewheel unit 503. The third switching unit 501 is coupled to the primary winding Np. The first secondary winding Ns1 and the second secondary winding Ns2 are connected in series. In addition, the primary winding Np, the first secondary winding Ns1, and the second secondary winding Ns2 are electrically coupled to each other. In greater detail, the primary winding Np, the first secondary winding Ns1, and the second secondary winding Ns2 may be wound around a magnetic core of a same transformer or magnetic cores of different transformers. In the present embodiment, the primary winding Np, the first secondary winding Ns1, and the second secondary winding Ns2 are wound around a magnetic core of a same transformer, but the present disclosure is not limited in this regard.

In addition, the freewheel unit 503 is electrically coupled to the first secondary winding Ns1 and the second secondary winding Ns2. The first secondary winding Ns1 and the second secondary winding Ns2 are coupled to the first illuminant unit 51 and the second illuminant unit 52 through the freewheel unit 503. Additionally, the freewheel unit 503 and the first secondary winding Ns1 form a release circuit. The release circuit is configured for releasing energy stored in the first primary winding Ns1.

In greater detail, the freewheel unit 503 comprises a fourth switching unit 5031 and a capacitor Cv. One terminal of the fourth switching unit 5031 is coupled to the first secondary winding Ns1. Another terminal of the fourth switching unit 5031 is coupled to one terminal of the capacitor Cv. The other terminal of the capacitor Cv is couple between the first secondary winding Ns1 and the second secondary winding Ns2. With such a configuration, the first secondary winding Ns1 can form the release circuit through the fourth switching unit 5031 and the capacitor Cv.

When the third switching unit 501 is turned on, the power conversion unit 50*a* receives an input voltage Vin and generates a current in the primary winding Np. In addition, the power conversion unit 50*a* stores the input voltage Vin in the primary winding Np, and respectively stores a first output voltage V1 and a second output voltage V2 in the first secondary winding Ns1 and the second secondary winding Ns2. Up to this time, the power conversion unit 50*a* has not yet generated any current in the first secondary winding Ns1 and the second secondary winding Ns2 because the first switching unit 53 and the second switching unit 54 have not been turned on yet.

When the second control unit 502 controls the third switching unit 501 to turn off, the first switching unit 53 and the second switching unit 54 have not been turned on yet. The fourth switching unit 5031 is conducted. The power conversion unit 50*a* releases the first output voltage V1 stored in the first secondary winding Ns1 through the release circuit and forms a capacitor voltage V3 across the capacitor Cv in the freewheel unit 503. In the present embodiment, the fourth switching unit 5031 may be a diode. When the third switching unit 501 is turned off, the first output voltage V1 in the first secondary winding Ns1 conducts the diode and charges the capacitor Cv through the diode so as to form the capacitor voltage V3 across the capacitor Cv. When the first switching unit 53 or the second switching unit 54 is turned on, an output voltage is co-generated by the freewheel unit 503 and the second secondary winding Ns2 to drive the first illuminant unit 51 and the second illuminant unit 52.

Figure 5B:
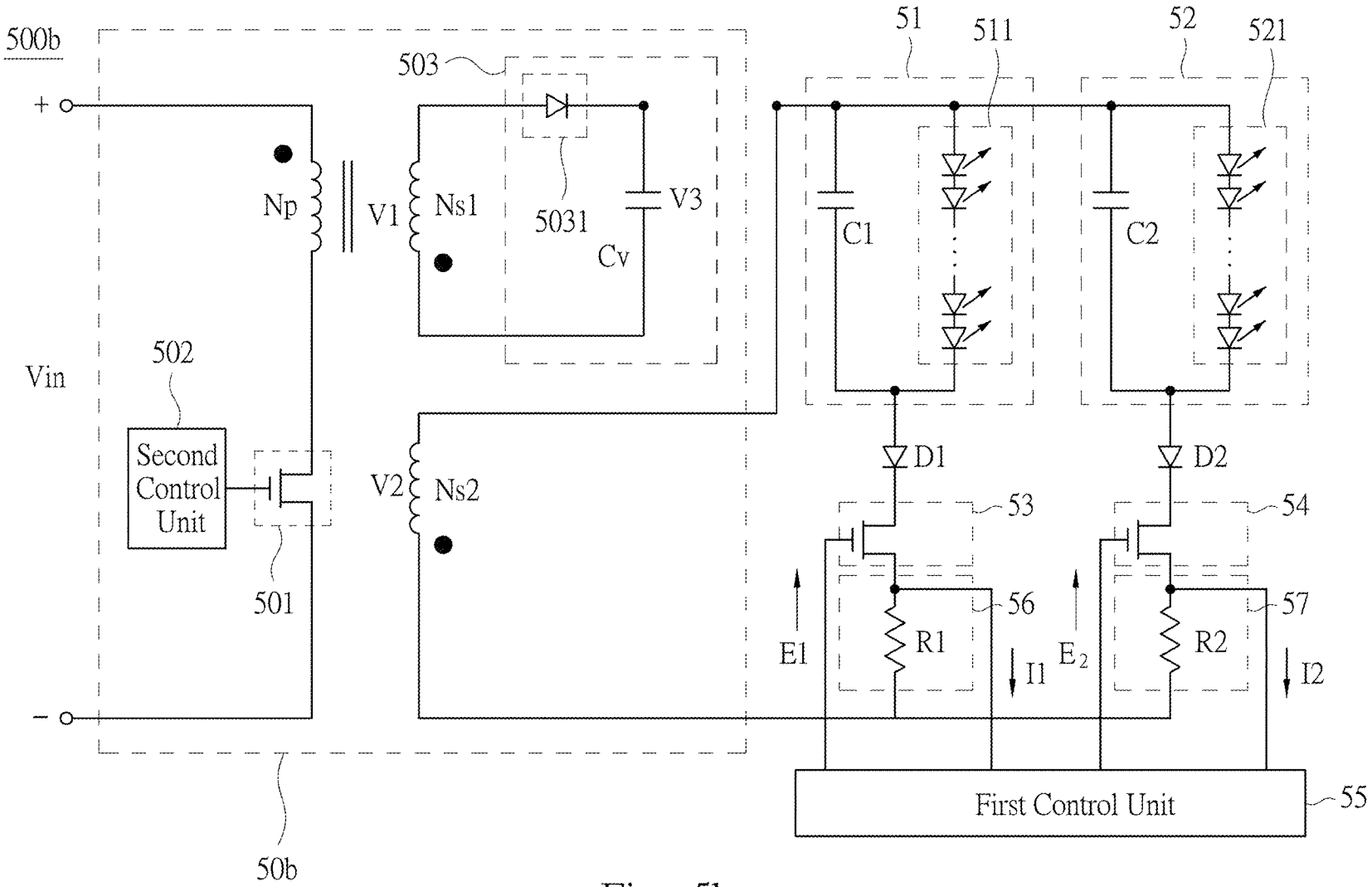
FIG. 5*b* depicts a circuit diagram of a light driving circuit according to yet another embodiment of this disclosure.

FIG. 5*b* depicts a circuit diagram of a light driving circuit 500*b* according to yet another embodiment of this disclosure. Similarly, the light driving circuit 500*b* comprises a power conversion unit 50*b*, the first illuminant unit 51, the second illuminant unit 52, the first switching unit 53, the second switching unit 54, the first control unit 55, the first current sampling unit 56, and the second current sampling unit 57. Similarly, the power conversion unit 50*b* comprises the freewheel unit 503 electrically coupled to the first secondary winding Ns1. In the power conversion unit 50*b*, the first secondary winding Ns1 is isolated from the second secondary winding Ns2 according to the present embodiment. Since the second secondary winding Ns2 is directly connected to the first illuminant unit 51 and the second illuminant unit 52, an output voltage is generated by the second secondary winding Ns2.

In other words, in the present embodiment, the light driving circuit 500*b* mainly provides the second output voltage V2 to drive the first illuminant unit 51 and the second illuminant unit 52. The freewheel unit 503 is connected in parallel with the first secondary winding Ns1 to form a release circuit. The primary winding Np, the first secondary winding Ns1, and the second secondary winding Ns2 are electrically coupled to each other. Additionally, the primary winding Np, the first secondary winding Ns1, and the second secondary winding Ns2 may be wound around a magnetic core of a same transformer or magnetic cores of different transformers, and the present embodiment is not limited in this regard. Since the connections and operations of the other units are similar to the connections and operations described in the above embodiment, a description in this regard is not provided.

Figure 5C:
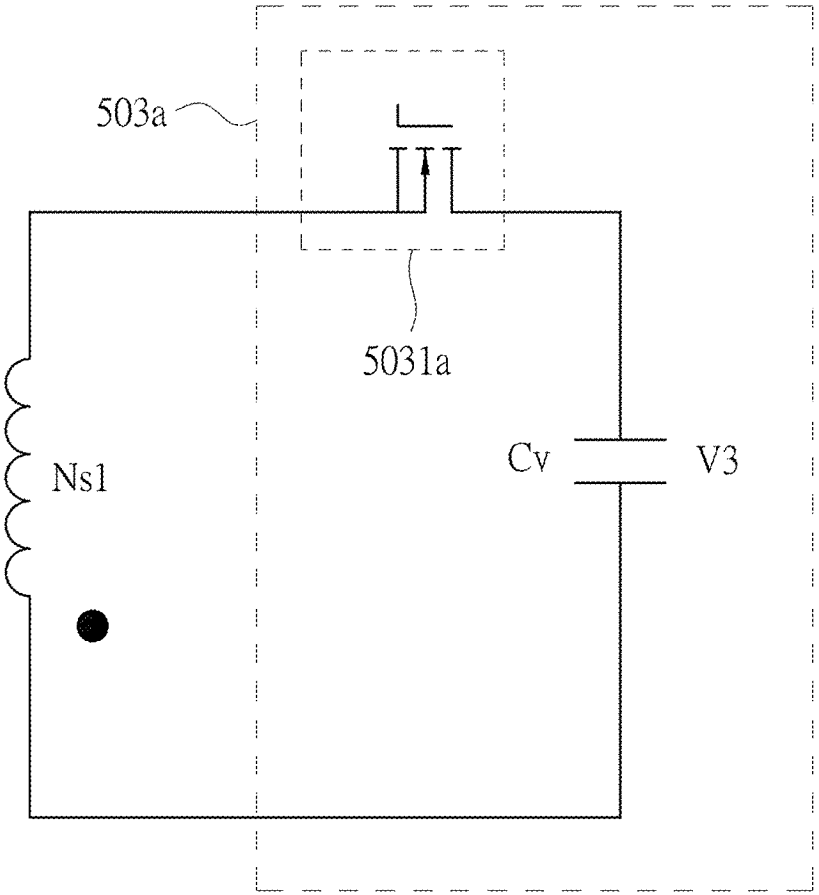
FIG. 5*c* depicts a schematic diagram of a freewheel unit according to another embodiment of this disclosure.

In one embodiment, the fourth switching unit 5031 in the freewheel unit 503 may be a switching device, such as a diode or a metal-oxide-semiconductor field effect transistor (MOSFET). In the embodiments shown in FIG. 5*a* and FIG. 5*b*, the fourth switching unit 5031 is a diode, but the present disclosure is not limited in this regard. FIG. 5*c* depicts a schematic diagram of a freewheel unit 503*a* according to another embodiment of this disclosure. In the present embodiment, the fourth switching unit 5031*a* in the freewheel unit 503*a* may be a synchronous rectification metal-oxide-semiconductor field effect transistor. With such a configuration, a conduction loss of the fourth switching unit 5031*a* is reduced. In addition, when the synchronous rectification metal-oxide-semiconductor field effect transistor is conducted, a reverse current will flow through the first secondary winding Ns1. Hence, a voltage across two terminals of the third switching unit (not shown in the figure) of the power conversion unit becomes low due to the resonance effect, thus reducing the conduction loss of the third switching unit.

In the above embodiment, not only the freewheel unit provide the secondary winding of the power conversion unit with a release circuit, but also the freewheel unit reduces the rated voltage endured by the switching unit coupled to each of the illuminant units so as to reduce the cost for disposing switches having high rated working voltages. To simplify matters, a description is provided by way of the light driving circuit 300*a* shown in FIG. 3*a* and the light driving circuit 500*a* shown in FIG. 5*a*. It is assumed that a ratio of turns of the primary winding Np to turns of the secondary winding Ns in the light driving circuit 300*a* is 4:1. A ratio of turns of the primary winding Np to turns of the first secondary winding Ns1 and to turns of the second secondary winding Ns2 in the light driving circuit 500*a* is 12:1:2. Additionally, the driving voltages required by the first light emitting diode string 311 and a first light emitting diode string 511 are both 40 volts. The capacitor voltage V3 formed in the freewheel unit 503 is 18 volts.

When the input voltage Vin is 400 volts, a reverse biased voltage that the first switching unit 33 in the light driving circuit 300*a* must endure is (400/4)*1+40=140 volts. A reverse biased voltage that the first switching unit 53 in the light driving circuit 500*a* must endure the voltage value of (400/12)*2−18+40=88.7 volts. It is understood from the above example that the rated working voltage of the switching unit is greatly reduced due to the disposition of the freewheel unit. In addition, the open-circuit voltage of the light driving circuit can be limited through limiting the capacitor voltage formed in the freewheel unit so as to save the cost for disposition of overvoltage protection circuit.

Figure 5D:
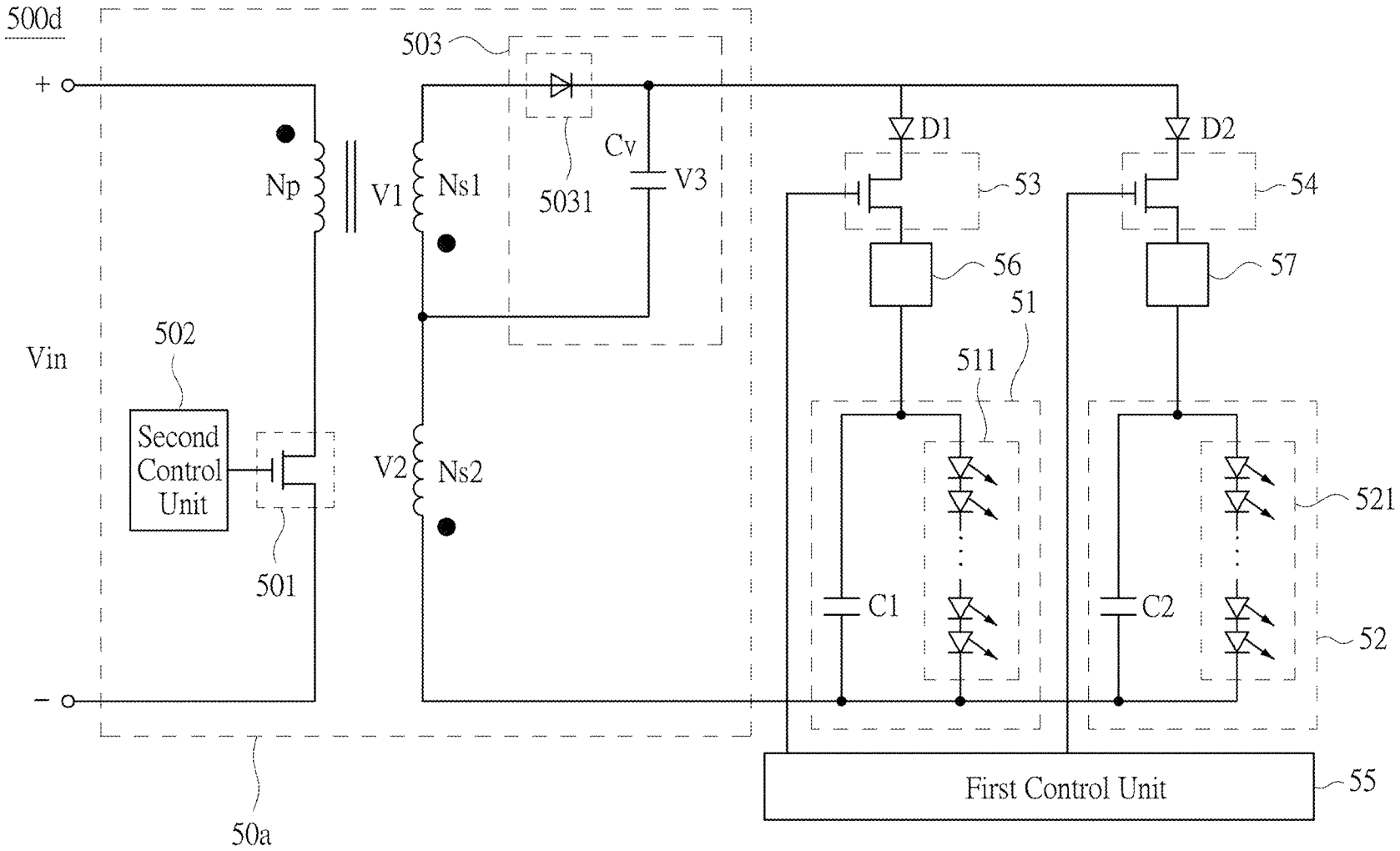
FIG. 5*d* depicts a circuit diagram of a light driving circuit according to another embodiment of this disclosure.

FIG. 5*d* depicts a circuit diagram of a light driving circuit 500*d* according to another embodiment of this disclosure. In the present embodiment, the first light emitting diode string 511 in the first illuminant unit 51 and a second light emitting diode string 521 in the second illuminant unit 52 may be connected in parallel to a common cathode (as compared with FIG. 5*a*, the first light emitting diode string 511 and the second light emitting diode string 521 are connected in parallel to a common anode). Since the connections and operations of the other units are similar to the connections and operations described in the above embodiment, a description in this regard is not provided.

Figure 6A:
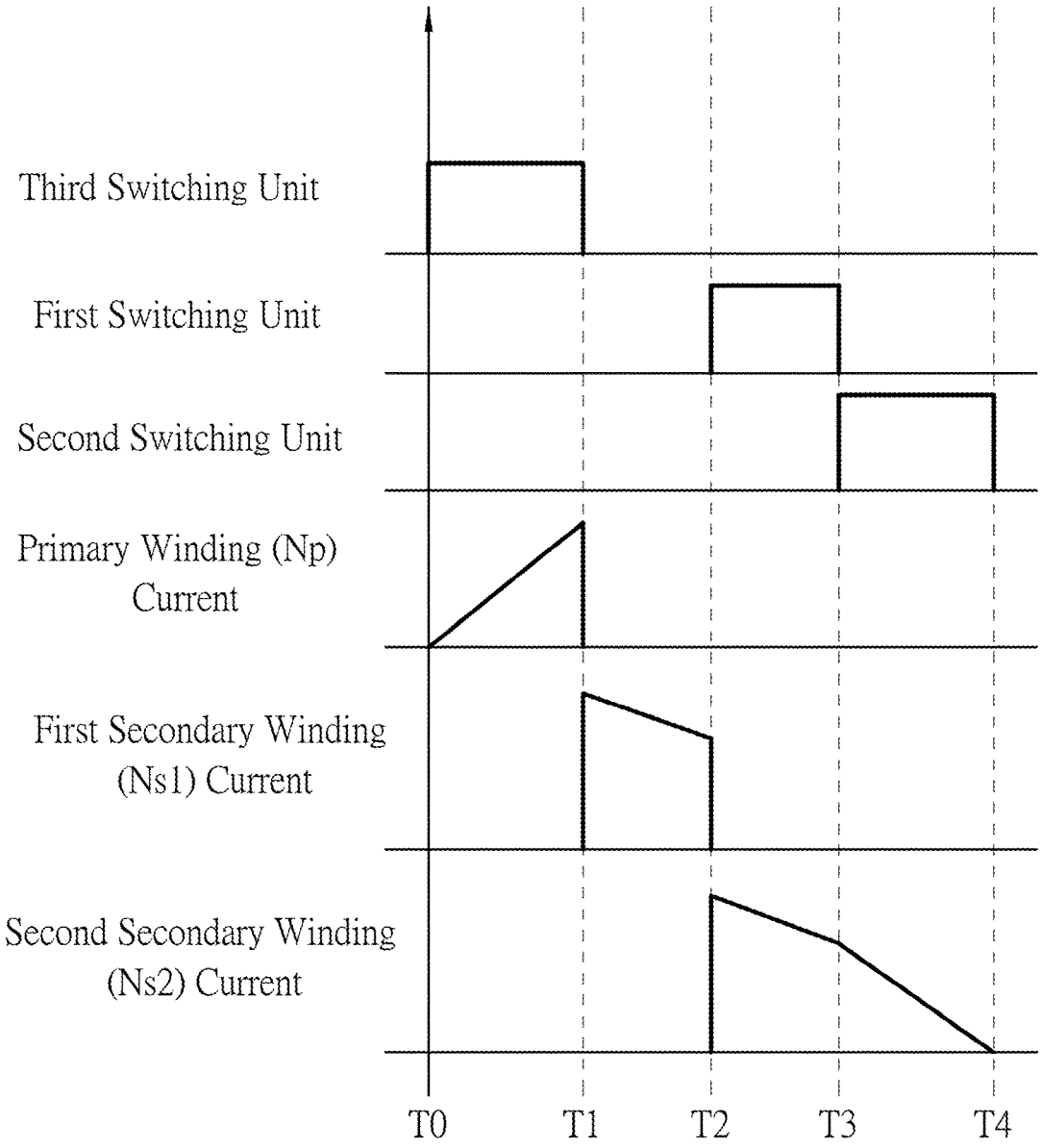
FIG. 6*a* depicts a control timing diagram according to yet another embodiment of this disclosure.

To simplify and clarify matters, a description is provided with reference to FIG. 5*a* and FIG. 6*a*. FIG. 6*a* depicts a control timing diagram according to yet another embodiment of this disclosure. In the present embodiment, a description is provided by way of the light driving circuit 500*a* shown in FIG. 5*a*, but the present disclosure is not limited in this regard. It is noted that, according to the present embodiment, the relationship between the capacitor voltage V3 formed in the freewheel unit 503 and the driving voltage VLEDm required by each of the light emitting diode strings satisfies: V3/N1>(VLEDm−V3)/N2, where m=1 or 2, N1 and N2 respectively denote the turns of the first secondary winding Ns1 and the turns of the second secondary winding Ns2. As shown in FIG. 6*a*, at time T0, the second control unit 502 turns on the third switching unit 501. The power conversion unit 50*a* starts to receive the input voltage Vin and generates the current in the primary winding Np. The first output voltage V1 and the second output voltage V2 are respectively stored in the first secondary winding Ns1 and the second secondary winding Ns2. Up to this time, not any current has yet been generated in the first secondary winding Ns1 and the second secondary winding Ns2 because both the first switching unit 53 and the second switching unit 54 have not been turned on yet.

Then, at time T1, the second control unit 502 controls the third switching unit 501 to turn off. The power conversion unit 50*a* converts to generate the output voltage that is sufficient to drive the first illuminant unit 51 and the second illuminant unit 52. At this time, the fourth switching unit 5031 is turned on by the first output voltage V1 stored in the first secondary winding Ns1. The release circuit formed by the first secondary winding Ns1, the fourth switching unit 5031, and the capacitor Cv starts to generate a current and forms the capacitor voltage V3 across the capacitor Cv. Up to this time, the current in the second secondary winding Ns2 has not yet been generated because the first switching unit 53 and the second switching unit 54 have not been turned on yet.

At time T2, the first control unit 55 turns on the first switching unit 53 and the fourth switching unit 5031 is turned off. At this time, the second output voltage V2 stored in the second secondary winding Ns2 and the capacitor voltage V3 of the capacitor Cv co-drives the first illuminant unit 51 and the output current in the second secondary winding Ns2 is generated. The first illuminant unit 51 is driven to emit light and generate the first output current I1. The first control unit 55 detects the first output current I1 and adjusts the duration of the on time of the first switching unit 53 according to the magnitude of the first output current I1.

After that, at time T3, the first illuminant unit 51 has acquired the sufficient power to maintain its rated duty, that is, the first output current I1 has reached a first rated current value. The first rated current value is equal to an average current value required by the first illuminant unit 51 for maintaining its rated duty. At this time, the first control unit 55 turns off the first switching unit 53 and turns on the second switching unit 54 so that the second output voltage V2 and the capacitor voltage V3 are changed to drive the second illuminant unit 52. The second illuminant unit 52 is driven to emit light and generate the second output current I2. Similarly, the first control unit 55 detects the second output current I2 and adjusts the duration of the on time of the second switching unit 54 according to the magnitude of the second output current I2.

Then, at time T4, when the first control unit 55 detects that the second output current I2 is zero, the output current in the second secondary winding Ns2 is zero. The first control unit 55 controls the second switching unit 54 to turn off, and the second control unit 502 controls the third switching unit 501 to turn on. That is, the operation comes back to the time T0. In this manner, the operation of controlling the light driving circuit 500*a* is completed.

Figure 6B:
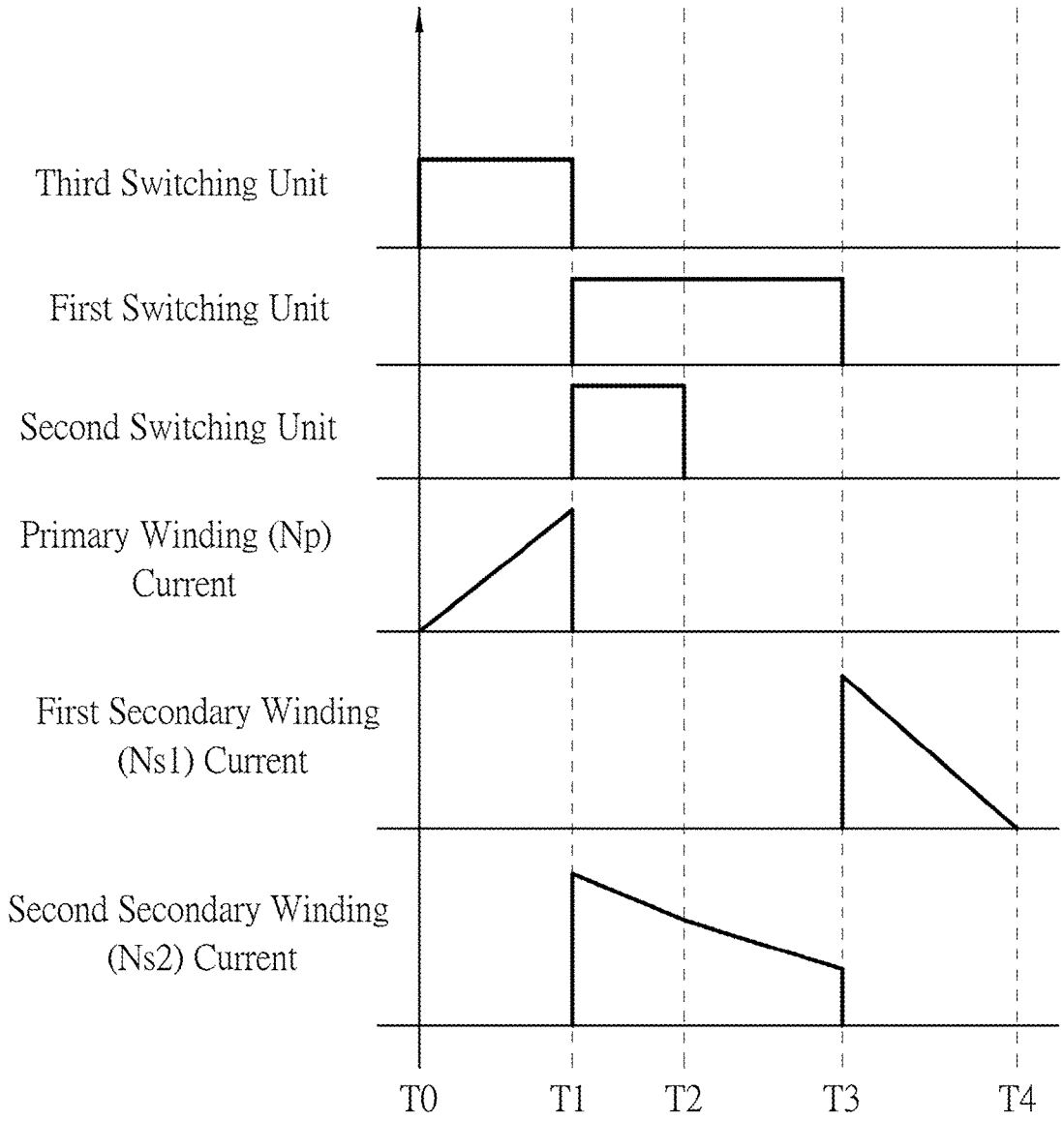
FIG. 6*b* depicts a control timing diagram according to another embodiment of this disclosure.

Besides the control method provided in FIG. 6*a*, the above light driving circuit 500*a* may be controlled by another control method. A description is provided with reference to FIG. 5*a* and FIG. 6*b*. FIG. 6*b* depicts a control timing diagram according to another embodiment of this disclosure. In the present embodiment, it is assumed that a driving voltage VLED1 required by the first light emitting diode string 511 is greater than a driving voltage VLED2 required by the second light emitting diode string 521 in the light driving circuit 500*a*. Additionally, the relationship between the capacitor voltage V3 and the driving voltage VLEDm required by each of the light emitting diode strings satisfies: V3/N1>(VLEDm−V3)/N2, where m=1 or 2, N1 and N2 respectively denote the turns of the first secondary winding Ns1 and the turns of the second secondary winding Ns2. As shown in FIG. 6*b*, at time T0, the second control unit 502 turns on the third switching unit 501. The power conversion unit 50*a* starts to receive the input voltage Vin and generates the current in the primary winding Np. The first output voltage V1 and the second output voltage V2 are respectively stored in the first secondary winding Ns1 and the second secondary winding Ns2. Up to this time, output current has not yet been generated in the first secondary winding Ns1 and output current has not yet been generated in the second secondary winding Ns2, respectively, because both the first switching unit 53 and the second switching unit 54 have not been turned on yet.

Then, at time T1, the second control unit 502 turns off the third switching unit 501, and the first control unit 55 turns on the first switching unit 53 and the second switching unit 54 simultaneously. Up to this time, the fourth switching unit 5031 has not turned on yet. Since the driving voltage VLED2 required by the second light emitting diode string 521 is smaller than the driving voltage VLED1 required by the first light emitting diode string 511, the second illuminant unit 52 is first co-driven by the second output voltage V2 stored in the second secondary winding Ns2 and the capacitor voltage V3 across the capacitor Cv to emit light and generate the second output current I2. At this time, the first control unit 55 detects the second output current I2 and adjusts the duration of the on time of the second switching unit 54 according to the magnitude of the second output current I2, that is, a period between the time T1 and a time T2. Hence, the power conversion unit 50*a* is able to provide sufficient power to drive the second illuminant unit 52.

After that, at time T2, the second illuminant unit 52 has acquired the sufficient power to maintain its rated duty. That is, the second output current I2 has reached a second rated current value. The second rated current value is equal to an average current value required by the second illuminant unit 52 for maintaining its rated duty. At this time, the first control unit 55 turns off the second switching unit 54. The second output voltage V2 and the capacitor voltage V3 across the capacitor Cv are changed to co-drive the first illuminant unit 51. The first illuminant unit 51 is driven to emit light and generates the first output current I1. Similarly, the first control unit 55 detects the first output current I1 and adjusts the duration of the on time of the second switching unit 54 according to the magnitude of the first output current I1.

Then, at time T3, the first control unit 55 detects that the first output current I1 has reached a first rated current value. The first rated current value is equal to an average current value required by the first illuminant unit 51 for maintaining its rated duty. The first control unit 55 controls the first switching unit 53 to turn off. At this time, the fourth switching unit 5031 is turned on and the capacitor Cv is charged by the first output voltage V1 stored in the first secondary winding Ns1. The first secondary winding Ns1, the fourth switching unit 5031, and the capacitor Cv form the release circuit. The release circuit starts to generate the current and form the capacitor voltage V3 across the capacitor Cv. By storing the capacitor voltage V3 in the capacitor Cv, the freewheeling of the secondary winding of the power conversion unit 50*a* is achieved.

After that, at time T4, the first control unit 55 detects that the current flowing through the first secondary winding Ns1 is zero. That is, the current flowing through the fourth switching unit 5031 is zero. The second control unit 502 turns on the third switching unit 501 again to proceed to the next cycle period continuously. In the present embodiment, the light driving circuit first drives the illuminant unit having low driving voltage, then drives the illuminant unit having high driving voltage, and finally releases the energy stored in the first secondary winding Ns1 to the capacitor Cv. With such a control method, the design complexity of the first control unit 55 is reduced and the operational stability of the light driving circuit is increased.

Figure 6C:
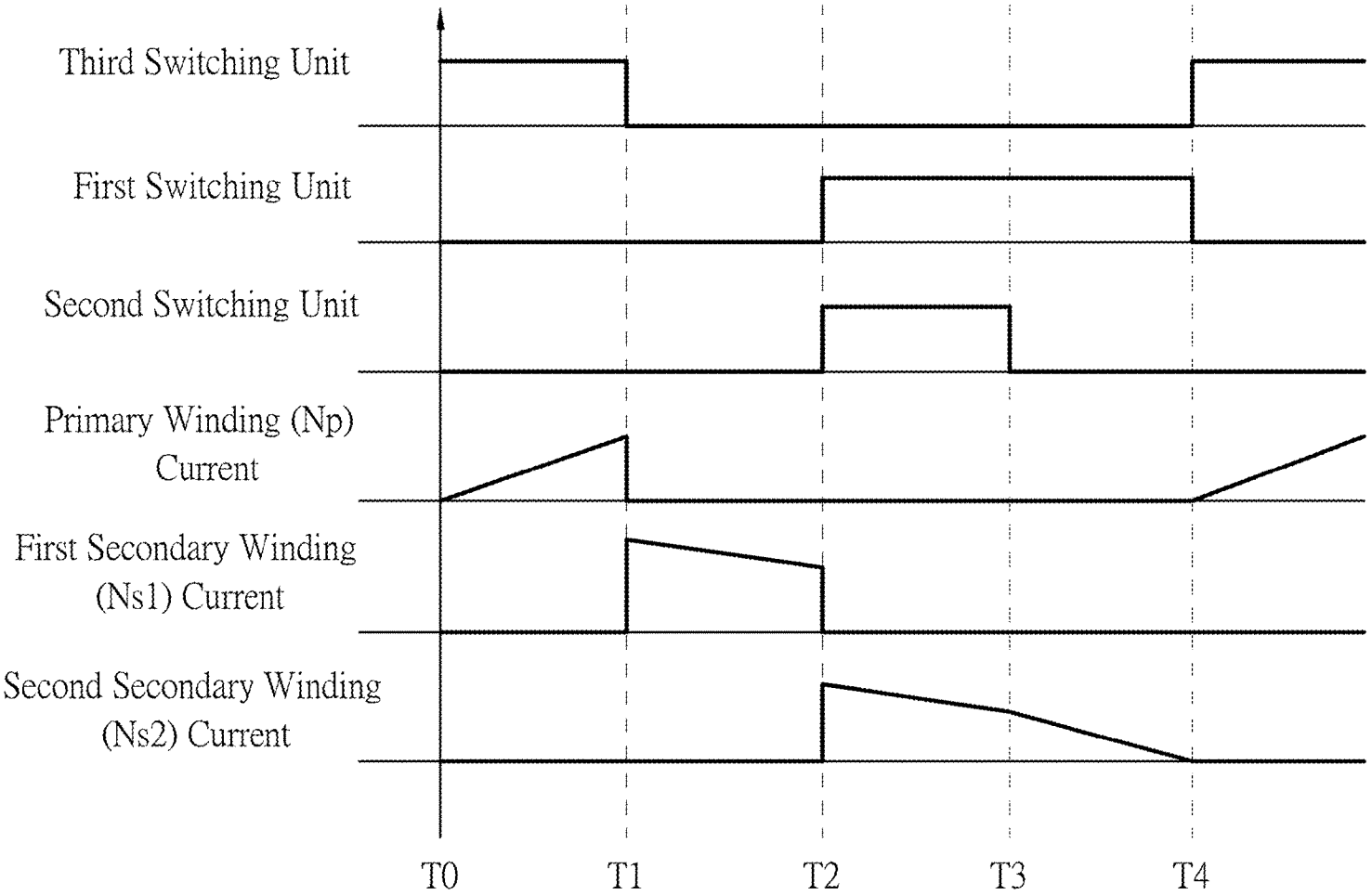
FIG. 6*c* depicts a control timing diagram according to still another embodiment of this disclosure.

Besides the control methods provided in FIG. 6*a* and FIG. 6*b*, the above light driving circuit 500*a* may be controlled by another control method. A description is provided with reference to FIG. 5*a* and FIG. 6*c*. FIG. 6*c* depicts a control timing diagram according to still another embodiment of this disclosure. In the present embodiment, it is assumed that the driving voltage VLED1 required by the first light emitting diode string 511 is greater than the driving voltage VLED2 required by the second light emitting diode string 521 in the light driving circuit 500*a*. Additionally, the relationship between the capacitor voltage V3 and the driving voltage VLEDm required by each of the light emitting diode strings satisfies: V3/N1>(VLEDm−V3)/N2, where m=1 or 2, N1 and N2 respectively denote the turns of the first secondary winding Ns1 and the turns of the second secondary winding Ns2.

As shown in FIG. 6*c*, at time T0, the second control unit 502 turns on the third switching unit 501. The power conversion unit 50*a* starts to receive the input voltage Vin and generates the current in the primary winding Np. The first output voltage V1 and the second output voltage V2 are respectively stored in the first secondary winding Ns1 and the second secondary winding Ns2. Up to this time, not any current has yet been generated in the first secondary winding Ns1 and the second secondary winding Ns2 because both the first switching unit 53 and the second switching unit 54 have not been turned on yet.

Then, at time T1, the second control unit 502 turns off the third switching unit 501. Up to this time, the first switching unit 53 and the second switching unit 54 have not been turned on yet. The fourth switching unit 5031 is turned on by the first output voltage V1 stored in the first secondary winding Ns1. The release circuit formed by the first secondary winding Ns1, the fourth switching unit 5031, and the capacitor Cv starts to generate the current and charge the capacitor Cv so as to form the capacitor voltage V3 across the capacitor Cv.

After that, at time T2, the first control unit 55 turns on the first switching unit 53 and the second switching unit 54 simultaneously. At this time, the fourth switching unit 5031 is turned off. Since the driving voltage VLED2 required by the second light emitting diode string 521 is smaller than the driving voltage VLED1 required by the first light emitting diode string 511, the second illuminant unit 52 is first co-driven by the second output voltage V2 stored in the second secondary winding Ns2 and the capacitor voltage V3 across the capacitor Cv to emit light and generate the second output current I2. At this time, the first control unit 55 detects the second output current I2 and adjusts the duration of the on time of the second switching unit 54 according to the magnitude of the second output current I2, that is, a period between the time T2 and a time T3. Hence, the power conversion unit 50*a* is able to provide sufficient power to drive the second illuminant unit 52.

Then, at time T3, the second illuminant unit 52 has acquired the sufficient power to maintain its rated duty. That is, the second output current I2 has reached a second rated current value. The second rated current value is equal to an average current value required by the second illuminant unit 52 for maintaining its rated duty. At this time, the first control unit 55 turns off the second switching unit 54. The second output voltage V2 and the capacitor voltage V3 across the capacitor Cv are changed to co-drive the first illuminant unit 51. The first illuminant unit 51 is driven to emit light and generate the first output current I1. Similarly, the first control unit 55 detects the first output current I1 and adjusts the duration of the on time of the second switching unit 54 according to the magnitude of the first output current I1.

After that, at time T4, when the first control unit 55 detects that the first output current I1 is zero, the output current in the second secondary winding Ns2 is zero. The first control unit 55 controls the first switching unit 53 to turn off and the second control unit 502 controls the third switching unit 501 to turn on. That is, the operation comes back to the time T0.

Figure 7:
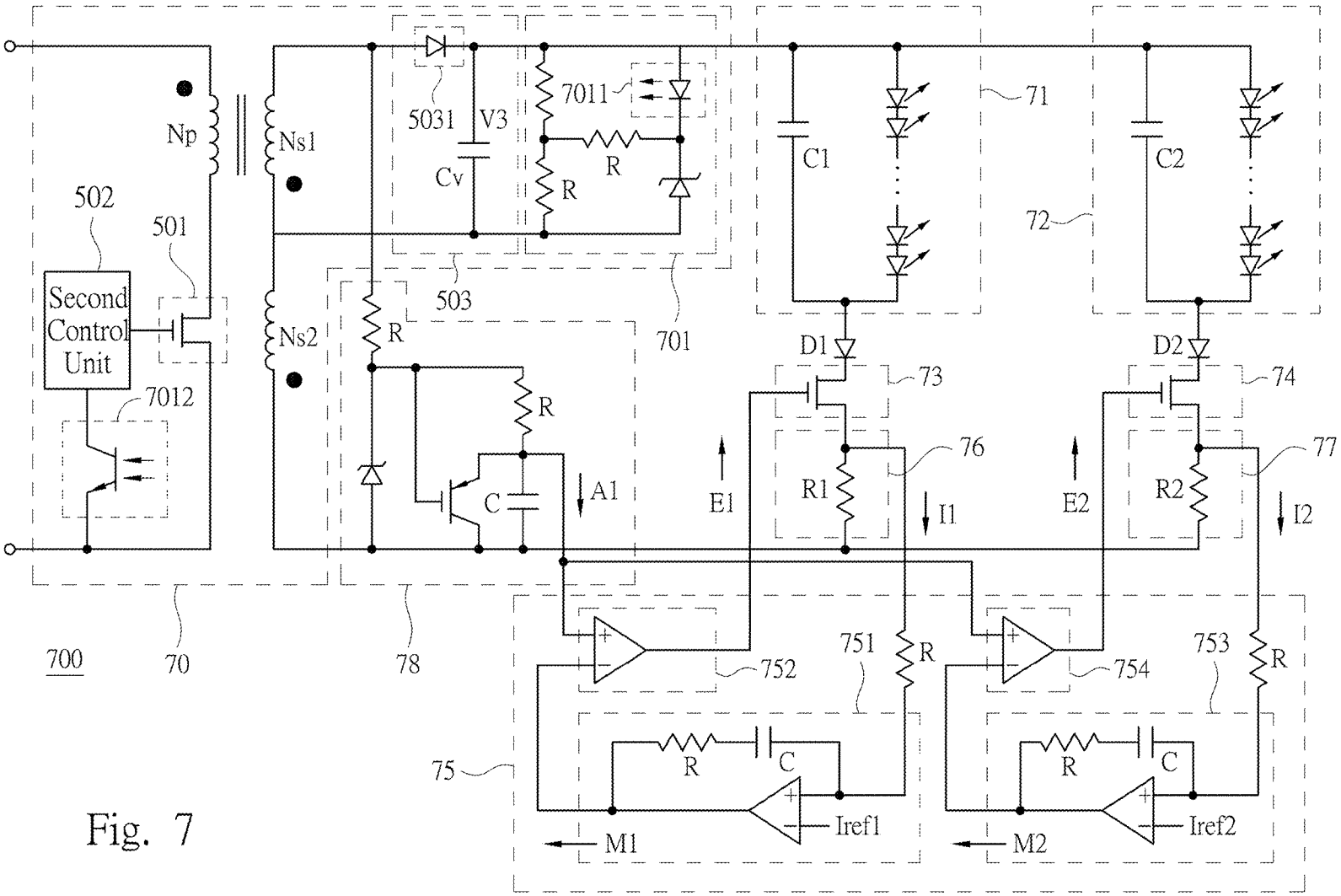
FIG. 7 depicts a circuit diagram of a light driving circuit according to still another embodiment of this disclosure.

FIG. 7 depicts a circuit diagram of a light driving circuit 700 according to still another embodiment of this disclosure. As shown in FIG. 7, the light driving circuit 700 comprises a power conversion unit 70, a first illuminant unit 71, a second illuminant unit 72, a first switching unit 73, a second switching unit 74, a first control unit 75, a first current sampling unit 76, a second current sampling unit 77, and a signal synchronizing unit 78. Since the connections and operations of the power conversion unit 70, the first illuminant unit 71, the second illuminant unit 72, the first switching unit 73, the second switching unit 74, the first control unit 75, the first current sampling unit 76, and the second current sampling unit 77 are similar to the connections and operations described in the above embodiment, a description in this regard is not provided.

The signal synchronizing unit 78 is connected in parallel with a first secondary winding Ns1 and a second secondary winding Ns2. The signal synchronizing unit 78 is configured for generating a synchronous signal A1 having a sawtooth voltage signal according to a first output voltage V1 stored in the first secondary winding Ns1 and a second output voltage V2 stored in the second secondary winding Ns2. The first control unit 75 may generate a first control signal E1 according to the synchronous signal A1 and a first output current I1 correspondingly. The first control signal E1 is configured for controlling the first switching unit 73 to be turned on or turned off. The first control unit 75 may also generate a second control signal E2 according to the synchronous signal A1 and a second output current I2 correspondingly. The second control signal E2 is configured for controlling the second switching unit 74 to be turned on or turned off.

In greater detail, the first control unit 75 comprises a first error amplifier 751 and a first comparator 752 corresponding to the first illuminant unit 71, and a second error amplifier 753 and a second comparator 754 corresponding to the second illuminant unit 72. When the first illuminant unit 71 is driven to generate the first output current I1, the first control unit 75 detects the first output current I1 through the first current sampling unit 76. Then, the first control unit 75 compares the first output current I1 with a first reference current Iref1 through the first error amplifier 751 and generates a first adjustment signal M1 to the first comparator 752. After that, the first control unit 75 compares the first adjustment signal M1 with the synchronous signal A1 through the first comparator 752 and generates a first control signal E1 to the first switching unit 73. The first control signal E1 is configured for adjusting a duration of an on time of the first switching unit 73 to allow an average current flowing through the first illuminant unit 71 to be adjusted. In the present embodiment, when a value of the first output current I1 is greater than a value of the first reference current Iref1, the first control unit 75 may reduce a duty cycle of the first control signal E1 through the first adjustment signal M1 and the synchronous signal A1. Consequently, the on time of the first switching unit 73 is decreased to adjust the average current flowing through the first illuminant unit 71. Similarly, when the second illuminant unit 72 is driven to generate the second output current I2, the first control unit 75 detects the second output current I2 through the second current sampling unit 77. Then, the first control unit 75 compares the second output current I2 with a second reference current Iref2 through the second error amplifier 753 and generates a second adjustment signal M2 to the second comparator 754. After that, the first control unit 75 compares the second adjustment signal M2 with the synchronous signal A1 through the second comparator 754 and generates a second control signal E2 to the second switching unit 74. The second control signal E2 is configured for adjusting a duration of an on time of the second switching unit 74 to allow an average current flowing through the second illuminant unit 72 to be adjusted.

In addition, in FIG. 7, the power conversion unit 70 further comprises a feedback unit 701. The feedback unit 701 is connected in parallel with the freewheel unit 503 and generates a feedback signal according to the capacitor voltage V3 across the capacitor Cv. The second control unit 502 may generate a third control signal according to the feedback signal. The third control signal is configured for controlling a duration of an on time of the third switching unit 501 so as to adjust an output voltage converted by the power conversion unit 70. In the present embodiment, the feedback unit 701 may comprises a photo coupler, but the present disclosure is not limited in this regard. The photo coupler comprises a light emitting device 7011 and a light receiving device 7012. The feedback unit 701 detects the capacitor voltage V3 and generates the feedback signal, and provides the feedback signal to the light emitting device 7011 of the photo coupler. The feedback signal is emitted by the light emitting device 7011 and a photo signal is received by the light receiving device 7012 of the photo coupler and converted into an electrical signal which is thereafter provided to the second control unit 502.

A control sequence of the light driving circuit 700 is similar to a control sequence of the embodiment shown in FIG. 6*b*. The difference is that the capacitor Cv is charged by the first output voltage V1 stored in the first secondary winding Ns1 when the fourth switching unit is turned on. When the capacitor voltage V3 reaches a predetermined value, the feedback unit 701 may generate the feedback signal according to the capacitor voltage V3. The second control unit 502 turns on the third switching unit 501 again according to the feedback signal to proceed to the next cycle period continuously. Since the other part of the sequence is similar to that of the embodiment shown in FIG. 6*b*, a description in this regard is not provided.

Figure 8:
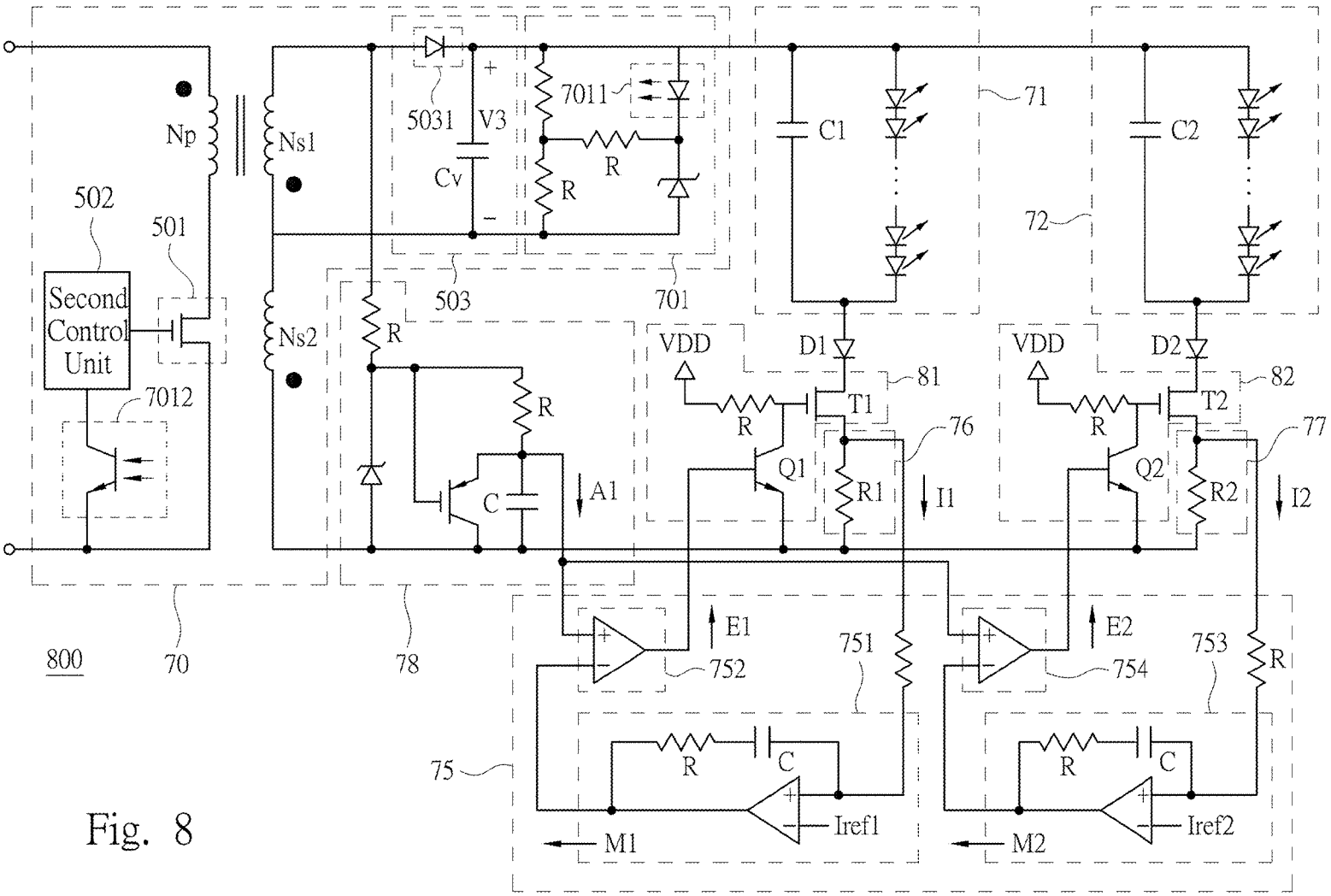
FIG. 8 depicts a circuit diagram of a light driving circuit according to yet another embodiment of this disclosure.

FIG. 8 depicts a circuit diagram of a light driving circuit 800 according to yet another embodiment of this disclosure. Similar to the light driving circuit 700 shown in FIG. 7, the light driving circuit 800 comprises the power conversion unit 70, the first illuminant unit 71, the second illuminant unit 72, a first switching unit 81, a second switching unit 82, the first control unit 75, the first current sampling unit 76, the second current sampling unit 77, and the signal synchronizing unit 78. The first switching unit 81 comprises a transistor T1 and a bipolar junction transistor (BJT) Q1. A collector electrode of the bipolar junction transistor Q1 is electrically connected to a gate electrode of the transistor T1. In addition, the collector electrode of the bipolar junction transistor Q1 is connected to a power supply VDD through a resistor R. A first control signal E1 is output to a base electrode of the bipolar junction transistor Q1. Similarly, the second switching unit 82 comprises a transistor T2 and a bipolar junction transistor Q2. A collector electrode of the bipolar junction transistor Q2 is electrically connected to a gate electrode of the transistor T2. In addition, the collector electrode of the bipolar junction transistor Q2 is connected to the power supply VDD through the resistor R. A second control signal E2 is output to a base electrode of the bipolar junction transistor Q2. Since the connections and operations of the other units are similar to the connections and operations described in the above embodiment, a description in this regard is not provided.

Figure 9:
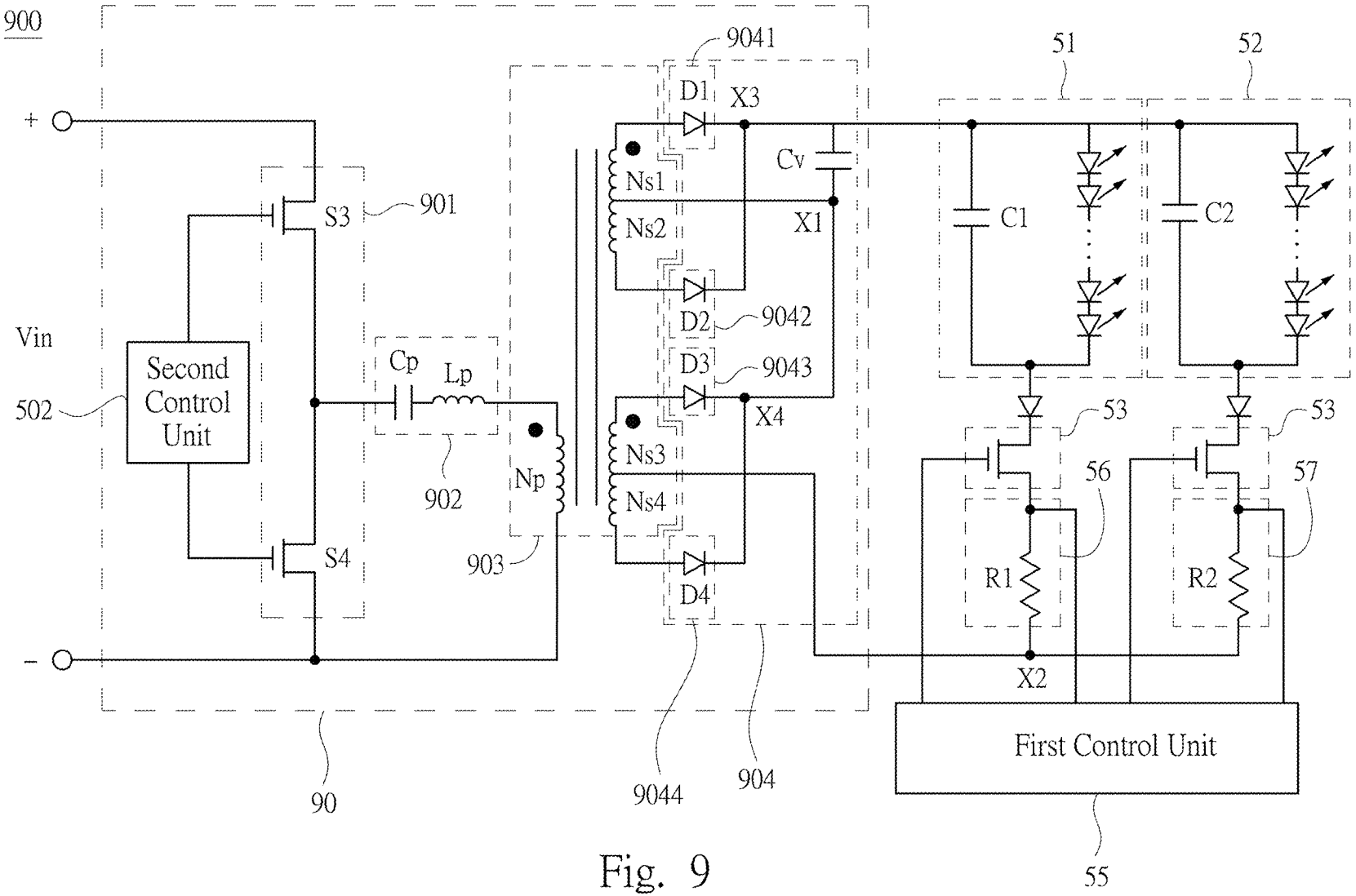
FIG. 9 depicts a circuit diagram of a light driving circuit according to another embodiment of this disclosure.

FIG. 9 depicts a circuit diagram of a light driving circuit 900 according to another embodiment of this disclosure. As shown in FIG. 9, a power conversion unit 90 of a light driving circuit 900 may be a half-bridge LLC converter. The power conversion unit 90 comprises a half bridge circuit 901, a resonant circuit 902, a transformer 903, a freewheel unit 904, and the second control unit 502. The half bridge circuit 901 may comprise a fifth switch S3 and a sixth switch S4. The fifth switch S3 and the sixth switch S4 are connected in series to from the half bridge circuit 901. Additionally, the fifth switch S3 and the sixth switch S4 may be respectively connected to other switching devices to form a full bridge circuit, and the present embodiment is not limited in this regard. In addition, one terminal of the resonant circuit 902 of the power conversion unit 90 is electrically coupled to a primary winding Np of the transformer 903, another terminal is electrically coupled between the fifth switch S3 and the sixth switch S4. The resonant circuit 902 comprises a resonant capacitor Cp and a resonant inductor Lp.

A secondary winding of the transformer 903 of the power conversion unit 90 comprises a first secondary winding Ns1, a second secondary winding Ns2, a third secondary winding Ns3, and a fourth secondary winding Ns4. The first secondary winding Ns1 and the second secondary winding Ns2 are connected in series and coupled to the freewheel unit 904. The fourth secondary winding Ns4 and the third secondary winding Ns3 are connected in series and coupled to the freewheel unit 904. The second control unit 502 is electrically coupled to the fifth switch S3 and the sixth switch S4 and is configured for controlling working frequencies or duty cycles of the fifth switch S3 and the sixth switch S4 so as to adjust an output voltage generated by the power conversion unit 90.

The first secondary winding Ns1 and the second secondary winding Ns2 are electrically connected to a connection point X1 through center tapping. The third secondary winding Ns3 and the fourth secondary winding Ns4 are electrically connected to a connection point X2 through center tapping. In addition, the freewheel unit 904 comprises a seventh switching unit 9041, an eighth switching unit 9042, a ninth switching unit 9043, a tenth switching unit 9044, and a capacitor Cv. The first secondary winding Ns1, the second secondary winding Ns2, the third secondary winding Ns3, and the fourth secondary winding Ns4 are electrically coupled to first terminals of the seventh switching unit 9041, the eighth switching unit 9042, the ninth switching unit 9043, and the tenth switching unit 9044, respectively. Each of the seventh switching unit 9041, the eighth switching unit 9042, the ninth switching unit 9043, and the tenth switching unit 9044 may be a diode, a synchronous rectification metal-oxide-semiconductor field effect transistor, etc., but the present disclosure is not limited in this regard. In the present embodiment, an explanation is provided by taking diodes for example. The first secondary winding Ns1, the second secondary winding Ns2, the third secondary winding Ns3, and the fourth secondary winding Ns4 are electrically coupled to anodes of the diodes D1, D2, D3, and D4, respectively. Cathodes of the diodes D1, D2 are electrically connected to a connection point X3. Cathodes of the diodes D3, D4 are electrically connected to connection point X4.

Additionally, the cathodes of the diodes D1, D2 are electrically coupled to a first terminal of the capacitor Cv through the connection point X3. The cathodes of the diodes D3, D4 are electrically coupled to a second terminal of the capacitor Cv through the connection point X4 and the connection point X1. The first illuminant unit 51 and the second illuminant unit 52 are coupled between the first terminal of the capacitor Cv and the connection point X2. In greater detail, the first secondary winding Ns1 and the second secondary winding Ns2 respectively charge the capacitor Cv through the diode D1 and the diode D2 so that the stable output voltage is obtained. The output voltage across the capacitor Cv and voltages stored in the third secondary winding Ns3 and the fourth secondary winding Ns4 will co-drive illuminant unit. Since the connections and operations of the other units according to the present embodiment are similar to the connections and operations described in the above embodiment, a description in this regard is not provided. It is understood from the above embodiments of the present disclosure that the light driving circuit is able to use one control unit to control and drive each of the illuminant units. As a result, the whole circuit architecture is simplified and the cost for disposition the buck converters is saved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of an embodiment, it is intended that the present disclosure cover modifications and variations of this disclosure provided they fall within the scope of the following claims and their equivalents.

What is claimed is:

1. A light driving circuit comprising:

a first illuminant unit;

a second illuminant unit;

a power conversion unit configured for generating an output voltage;

a first switching unit coupled to the first illuminant unit, the first illuminant unit being driven by the output voltage to emit light and generate a first output current when the first switching unit is turned on;

a first current sampling unit connected in series with the first switching unit configured for detecting the first output current;

a second switching unit coupled to the second illuminant unit, the second illuminant unit being driven by the output voltage to emit light and generate a second output current when the second switching unit is turned on;

a second current sampling unit connected in series with the second switching unit configured for detecting the second output current; and a first control unit configured for controlling the first switching unit and the second switching unit to be turned on and turned off according to the first output current and the second output current, respectively, wherein the power conversion unit comprises:

a first switch;

a second switch connected in series with the first switch;

a resonant circuit having a first terminal and a second terminal, wherein the first terminal is electrically connected between the first switch and the second switch wherein the resonant circuit has a resonant capacitor and a resonant inductor;

a transformer having a primary winding and a secondary winding, and the secondary winding comprises a first secondary winding and a second secondary winding, wherein the second terminal of the resonant circuit is electrically connected to the primary winding;

a first diode and a second diode, anodes of the first diode and the second diode are respectively coupled to the first secondary winding and the second secondary winding, and cathodes of the first diode and the second diode are coupled to the first illuminant unit and the second illuminant unit; and a second control unit coupled to the first switch and the second switch configured for generating a third control signal according to a feedback signal, the third control signal being configured for controlling working frequencies or duty cycles of the first switch and the second switch so as to adjust the output voltage generated by the power conversion unit.

2. The light driving circuit of claim 1, wherein the first control unit turns on the first switching unit at a first time, and the first control unit turns off the first switching unit and turns on the second switching unit when the first output current reaches a rated current value.

3. The light driving circuit of claim 1, wherein the first control unit turns on the first switching unit and the second switching unit at a first time, and the first control unit turns off the second switching unit when the second output current reaches a rated current value.

4. The light driving circuit of claim 1, wherein the first control unit generates a first control signal for controlling a duration of an on time of the first switching unit according to the first output current, and generates a second control signal for controlling a duration of an on time of the second switching unit according to the second output current.

5. The light driving circuit of claim 1, wherein the first control unit generates the feedback signal according to the first output current and/or the second output current.

6. The light driving circuit of claim 1, wherein the first control unit turns on the first switching unit when the second control unit turns on the first switch, the first control unit turns off the first switching unit and turns on the second switching unit when the first output current reaches a rated current value, and the first control unit turns off the second switching unit and the second control unit turns off the fourth switching and turns on the second switch when the second output current is zero.

7. The light driving circuit of claim 1, wherein the first illuminant unit comprises a first light emitting diode string and a first capacitor connected in parallel with the first light emitting diode string, the second illuminant unit comprises a second light emitting diode string and a second capacitor connected in parallel with the second light emitting diode string.

8. The light driving circuit of claim 1, further comprising:

a third diode connected in series between the first switching unit and the first illuminant unit; and a fourth diode connected in series between the second switching unit and the second illuminant unit.

9. The light driving circuit of claim 1, wherein each of the first current sampling unit and the second current sampling unit is a resistor.

* * * * *